US007549554B2

(12) United States Patent
Hassell et al.

(10) Patent No.: US 7,549,554 B2
(45) Date of Patent: Jun. 23, 2009

(54) PORTABLE STORAGE CONTAINER

(75) Inventors: Jon P. Hassell, Atlanta, GA (US); Justin M. Smyers, Redondo Beach, CA (US); William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 730 days.

(21) Appl. No.: 10/949,592

(22) Filed: Sep. 24, 2004

(65) Prior Publication Data

US 2006/0065567 A1 Mar. 30, 2006

(51) Int. Cl.
*B65D 21/00* (2006.01)
*B65D 85/62* (2006.01)

(52) U.S. Cl. ..... 220/506

(58) Field of Classification Search ..... 206/503, 206/505, 506
See application file for complete search history.

(56) References Cited

U.S. PATENT DOCUMENTS

| | | | |
|---|---|---|---|
| 2,029,746 | A | 2/1936 | Tufts et al. |
| 2,061,414 | A | 11/1936 | Tufts et al. |
| 2,134,875 | A | 11/1938 | Henze |
| 2,609,120 | A | 9/1952 | Williams |
| 3,220,603 | A | 11/1965 | Bromley |
| 3,323,673 | A | 6/1967 | Cowan |
| 3,940,018 | A | 2/1976 | Scholle |
| 3,951,265 | A | 4/1976 | Carroll |
| 4,106,623 | A | 8/1978 | Carroll |
| 4,109,791 | A | 8/1978 | Clipson et al. |
| 4,241,831 | A | 12/1980 | Locatelli |
| 4,247,004 | A | 1/1981 | Bird |
| 4,391,369 | A | 7/1983 | Stahl |
| 4,423,813 | A | 1/1984 | Kreeger et al. |
| 4,466,541 | A | 8/1984 | Tabler et al. |
| 4,573,577 | A | 3/1986 | Miller |
| RE32,223 | E | 8/1986 | Kreeger et al. |
| 4,643,310 | A | 2/1987 | Deaton et al. |
| 4,759,451 | A | 7/1988 | Apps |
| 4,770,300 | A | 9/1988 | Klein |
| 4,848,578 | A | 7/1989 | Schafer |
| 4,863,062 | A | 9/1989 | Holliday |

(Continued)

FOREIGN PATENT DOCUMENTS

| | | |
|---|---|---|
| DE | 35 11 321 | 10/1986 |

(Continued)

OTHER PUBLICATIONS

International Search Report, Oct. 31, 2005.

(Continued)

*Primary Examiner*—Anthony D Stashick
*Assistant Examiner*—Harry A Grosso
(74) *Attorney, Agent, or Firm*—Carlson, Gaskey & Olds

(57) ABSTRACT

A portable storage container that both stacks and nests with similar containers includes a plurality of walls extending upwardly from a floor. At least one bail member is moveable between a plurality of positions for supporting the similar containers at varying heights. The bail member includes at least one rib extending radially outward. A similar container stacked on the bail members of the container will interlock with the at least one rib, thereby preventing lateral movement of the upper container relative to the lower container.

29 Claims, 31 Drawing Sheets

U.S. PATENT DOCUMENTS

| | | | | |
|---|---|---|---|---|
| 4,905,833 | A | 3/1990 | Kreeger et al. | |
| 4,947,992 | A | 8/1990 | Schafer | |
| 4,982,844 | A | 1/1991 | Madan et al. | |
| 5,083,666 | A | 1/1992 | Lam | |
| 5,415,293 | A | 5/1995 | Ackermann | |
| 5,469,986 | A | 11/1995 | Jang | |
| 5,494,163 | A | 2/1996 | Apps | |
| 5,609,254 | A | 3/1997 | Loftus et al. | |
| 5,617,953 | A | 4/1997 | Cope | |
| D381,203 | S | 7/1997 | Ackermann | |
| D382,404 | S | 8/1997 | Cope | |
| 5,752,602 | A | 5/1998 | Ackermann | |
| 5,772,033 | A | 6/1998 | Loftus et al. | |
| 5,881,902 | A | 3/1999 | Ackermann | |
| 5,924,572 | A | 7/1999 | Cope | |
| 6,059,114 | A | 5/2000 | Loftus | |
| D436,729 | S | 1/2001 | Aiken | |
| 6,938,772 | B2 | 9/2005 | Aiken et al. | |
| 7,014,043 | B2 | 3/2006 | Raghunathan et al. | |
| 7,017,745 | B2 | 3/2006 | Raghunathan | |
| 2002/0117420 | A1 | 8/2002 | McDade | |
| 2002/0179480 | A1 | 12/2002 | Raghunathan et al. | |
| 2003/0155366 | A1* | 8/2003 | Raghunathan | 220/835 |
| 2003/0230510 | A1 | 12/2003 | Aiken et al. | |
| 2005/0224385 | A1 | 10/2005 | Hassell et al. | |
| 2005/0263423 | A1 | 12/2005 | Hassell et al. | |
| 2005/0263424 | A1 | 12/2005 | Hassell et al. | |
| 2006/0108372 | A1 | 5/2006 | Aiken et al. | |
| 2006/0231449 | A1 | 10/2006 | Hassell et al. | |

FOREIGN PATENT DOCUMENTS

| | | | |
|---|---|---|---|
| DE | 35 21 894 | | 1/1987 |
| DE | 199 39 019 | A1 | 2/2001 |
| DE | 200 02 537 | U1 | 7/2001 |
| EP | 0 311 174 | A1 | 4/1989 |
| EP | 0 368 713 | | 5/1990 |
| EP | 0 557 002 | A | 8/1993 |
| EP | 0 697 341 | A | 2/1996 |
| EP | 0 953 509 | A1 | 3/1999 |
| EP | 0 926 073 | A | 6/1999 |
| EP | 1170223 | | 1/2002 |
| EP | 1241105 | | 9/2002 |
| FR | 2 678 585 | | 1/1993 |
| GB | 2 124 588 | A | 2/1984 |
| GB | 2 129 401 | | 5/1984 |
| GB | 2 137 167 | | 10/1984 |
| GB | 2 141 778 | | 1/1985 |
| GB | 2 171 980 | | 9/1986 |
| GB | 2 180 821 | | 4/1987 |
| GB | 2 209 737 | | 5/1989 |
| GB | 2296009 | | 6/1996 |
| GB | 2333285 | | 7/1999 |
| GB | 2340485 | | 2/2000 |
| GB | 2350350 | | 11/2000 |
| GB | 2373239 | | 9/2002 |
| GB | 2373240 | | 9/2002 |
| GB | 2 374 859 | A | 10/2002 |
| GB | 2425302 | | 10/2006 |
| GB | 2427606 | | 1/2007 |
| NL | 790 5105 | | 6/1979 |
| SU | 171783 | | 3/1966 |
| TW | 338405 | | 8/1998 |
| TW | 372539 | | 10/1999 |
| WO | WO 98/01352 | | 1/1998 |
| WO | WO/0027716 | | 5/2000 |
| WO | 00/51900 | | 9/2000 |
| WO | WO 00/66440 | | 11/2000 |
| WO | 2005100179 | | 10/2005 |
| WO | 2005115854 | | 12/2005 |
| WO | 2006036868 | | 4/2006 |

OTHER PUBLICATIONS

International Search Report, Aug. 24, 2005.
International Search Report, Feb. 13, 2006.
United Kingdom Search Report, Jun. 27, 2006.
International Preliminary Report on Patentability for Application No. PCT/US2005/034355, Apr. 5, 2007.

* cited by examiner

PORTABLE STORAGE CONTAINER

BACKGROUND OF THE INVENTION

The present invention relates generally to portable storage containers and more particularly to portable storage containers that provide the ability to select different nesting and stacking depths.

Portable storage containers that both stack and nest with similar containers are commonly used for transporting and storing goods. Nesting is typically achieved when an empty container receives a like container therein such that there is at least some overlap between the walls of the containers. The stacking feature is typically used when an occupied container has a like container supported thereon, such that the goods contained in the lower container are preferably not contacted or damaged by the upper container. Many containers use members (known as bail members) to achieve the stacking feature. Bail members may typically be positioned out of the way for purposes of nesting, but then moved to a stacking position for allowing containers to be stacked thereon.

The bail members in some containers are movable among three positions: a nesting position, a first stack position and a second stack position. In the nesting position, the bail members are out of the way and the upper container can substantially nest within the lower container. The bail members support containers in the first stack position at a first distance from the floor, where the upper container is not substantially nested within the lower container. The bail members also can be moved to the second stack position to support the upper container at a second distance from the floor, where the upper container is partially nested within the lower container.

SUMMARY OF THE INVENTION

A portable storage container that both stacks and nests with similar containers includes a plurality of walls extending upwardly from a floor. At least one bail member is moveable between a plurality of positions for supporting the similar containers at varying heights. The bail member includes a support portion pivotably connected to the container by arms at each end. The bail member includes at least one rib extending radially outward from the support portion. A similar container stacked on the bail members of the container will interlock with the at least one rib, thereby preventing lateral movement of the upper container relative to the lower container.

The bail member further includes a plurality of microribs on substantially the entire surface of the support portion. This prevents loose stickers, washed from the container, from sticking to the bail members.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
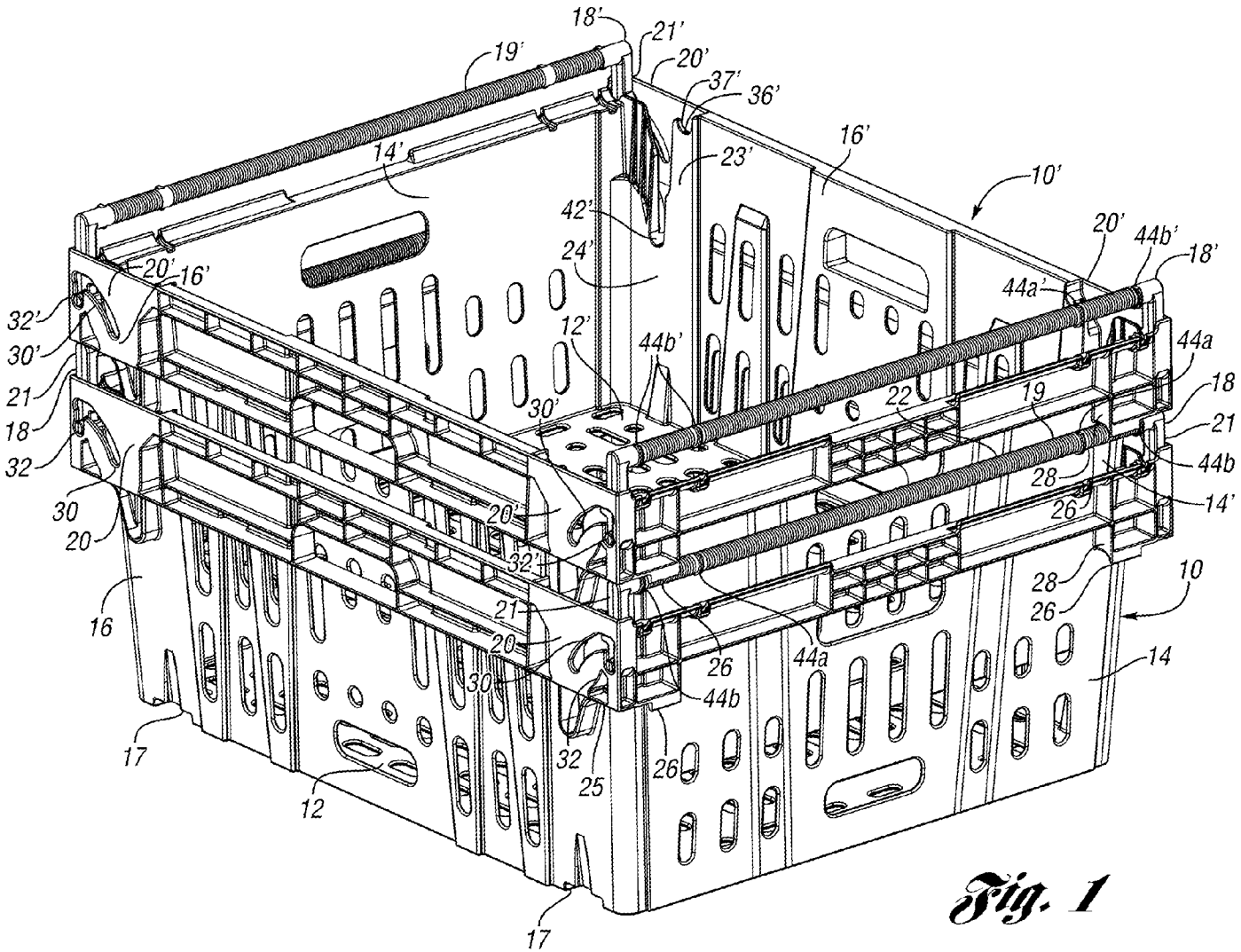
FIG. 1 is a perspective view of a container according to a first embodiment of the present invention with the bail members in a high nest position and with a similar container nested therein.

Two like containers 10, 10' according to the present invention are shown stacked in FIG. 1. Generally, the description will be with reference to the lower container 10, although in the example shown in FIG. 1, the description would be equally applicable to the upper container 10'. The container 10 includes a floor 12 and a pair of opposed side walls 14 and a pair of opposed end walls 16. A pair of notches 17 are formed at the bottom of the end walls 16 and the floor 12. The notches 17 each define a channel which extends one end wall 16 to the other.

Figure 2:
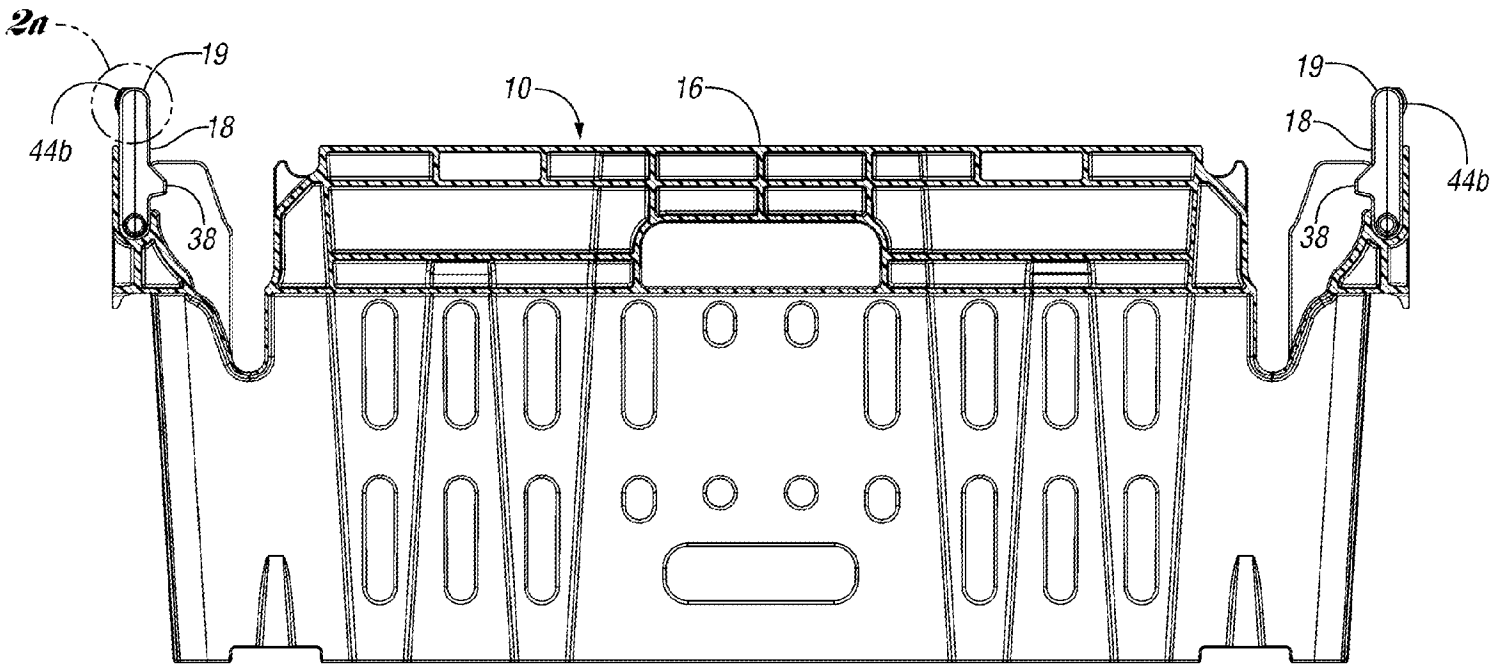
FIG. 2 shows a sectional view of the lower container of FIG. 1, with the bail members in the high nest position.

Two bail members 18 are each mounted to each end wall 16. While they may take a variety of shapes, bail members 18 are shown as molded plastic having a generally cylindrical support portion 19 that extends across the length of the container 10. Each bail member 18 includes a pair of arms 21 extending transversely from the support portion 19. As shown in FIG. 2, each arm 21 includes an inward, lateral projection 38 that provides additional weight to the bail member 18, increases stiffness and resistance to twisting and increases stability.

Each bail member 18 includes a plurality of circumferential molded micro-ribs 22 on the support portion 19 providing alternating recesses and protrusions all along substantially the entire surface of the support portion 19. The microribs 22 are substantially smaller than the diameter of the support portion 19 of the bail member 18, e.g. less than five percent. The microribs 22 are also tightly spaced axially along the support portion 19, such that the spaces between the microribs 22 are not wider than the microribs 22 themselves. In the example shown, the width of the spaces between the microribs 22 is approximately equal to the width of the microribs 22. The microribs 22 help prevent stickers, washed from the container 10, from sticking to the bail members 18 when washing the container 10 by reducing the available surface area of the support portion 19.

The end walls 16 each include an upper wall portion that has an outer wall portion 20 spaced from an inner wall portion 23. A lower wall portion 24 is generally aligned below the inner wall portion 23, such that the outer wall portion 20 forms a support or ledge 25 along the end wall 16. The side walls 14 similarly include ledges 26 protruding outwardly from the side walls 14 at a height even with the ledges 25 on the end walls 16. The ledges 26 on the side walls 14 include lower concave recesses 28 formed along their length.

The inner wall portion 23 includes an upper support rest 36 at a height above the floor 12 for supporting the bail member 18 at an upper stack position. Each upper support rest 36 includes an upwardly open concave recess 37, which is a notch formed in the inner wall portion 23. The inner wall portion 23 further includes a lower support rest 42, which is closer to the floor than the upper support rest 36, for supporting the bail member 18 at a lower stack position.

Elongated pin openings 30 are formed in each outer wall portion 20 to trap pins 32 at the outer ends of the bail members 18. The pins 32 are slidable and pivotable within the pin openings 30, such that the bail members 18 can be moved to a plurality of positions and orientations.

In FIGS. 1-4, the bail members 18 are in a high nest position. The pins 32 of the bail members 18 are slid to an outer end of the pin opening 30 and the bail members 18 are pivoted to an upright position, as shown. In the high nest position, the support portions 19 of the bail members 18 are spaced above uppermost edges of the side walls 14 and end walls 16.

The bail member 18 in the high nest position supports a similar container 10', such that the floor 12' of the upper container 10' is suspended at a distance above the floor 12 of the lower container 10. The floor 12' of the upper container 10' is not in contact with the support portion 19 of the bail member 18 of the lower container 10. In this position, the upper container 10' is supported by the support portions 19 of the bail members 18 of the lower container 10, with the support portions 19 received in the concave recesses 28' formed in the ledges 26' on the side walls 14'. This position provides a small storage space between the floors 12, 12' of the containers.

Figure 2A:
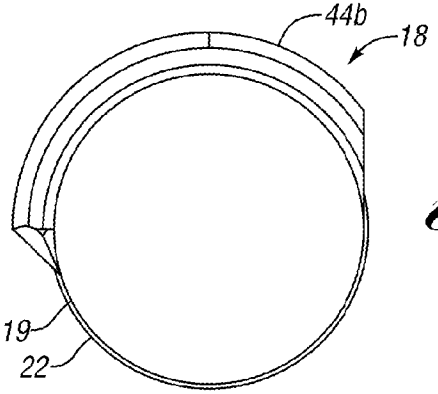
FIG. 2*a* is an enlarged view of the area 2*a* of FIG. 2.

The support portions 19 of the bail members 18 each include a pair of inner radially-protruding interlocking projections 44*a* and a pair of outer radially-protruding interlocking projections 44*b*. The inner and outer interlocking projections 44*a-b* extend partially about the circumference of the support portion 19 and are at least several times greater in size than the microribs 22, for example, the inner and outer interlocking projections 44*a-b* are approximately ten times greater in radial thickness than the microribs 22. In the example shown, as can be seen in FIG. 2*a*, the inner and outer interlocking projections 44*a-b* (only outer interlocking projections 44*b* visible in FIG. 2*a*) extend halfway around the circumference of the support portion 19, tapering into the support portions at the ends of the interlocking projections 44*a-b*. A portion of one of the microribs 22 is also shown in FIG. 2*a*. Each microrib 22 is approximately 0.0075" in radial height and has a half-circle cross-section.

Figure 3:
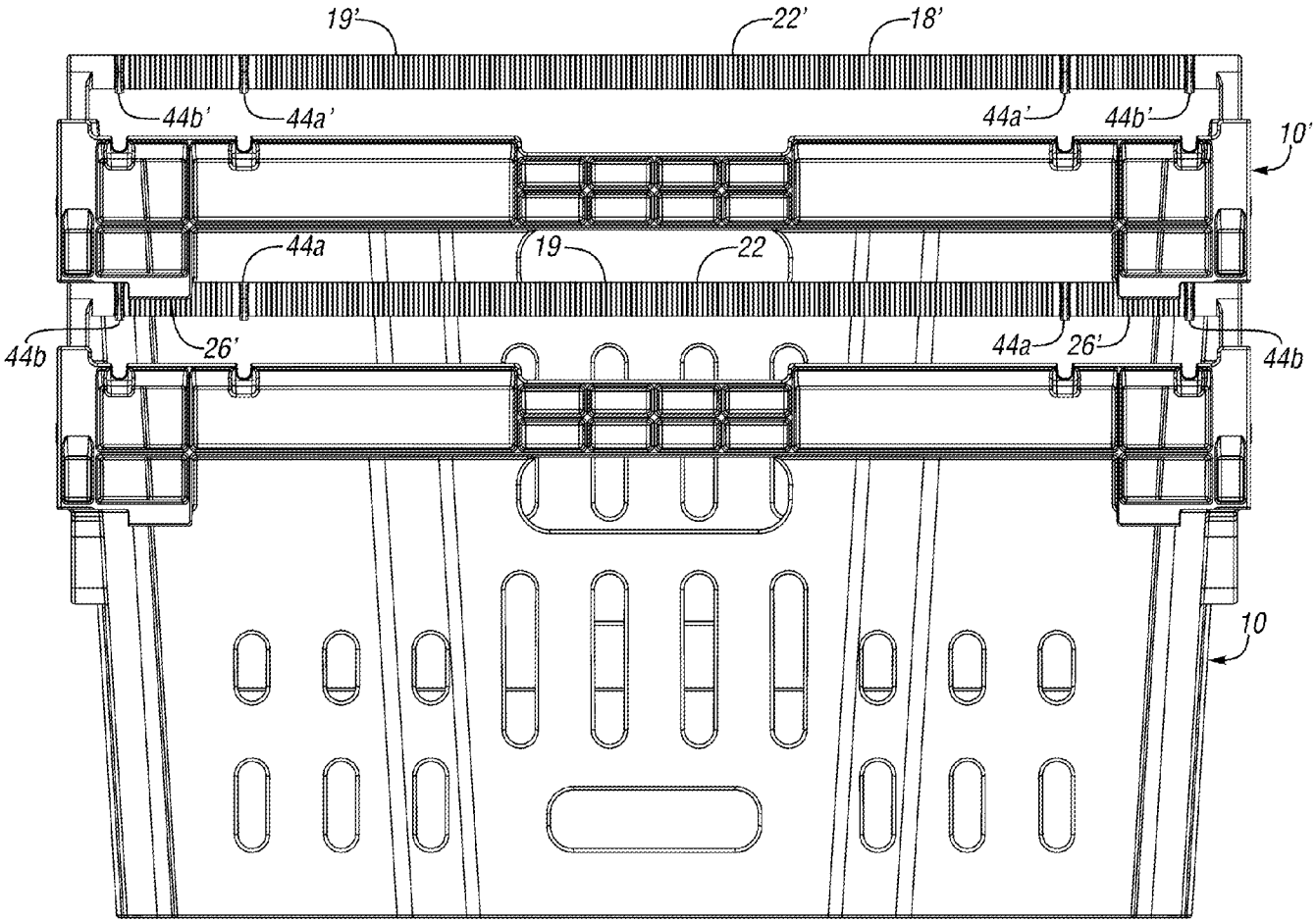
FIG. 3 is a side view of the containers of FIG. 1.
Figure 4:
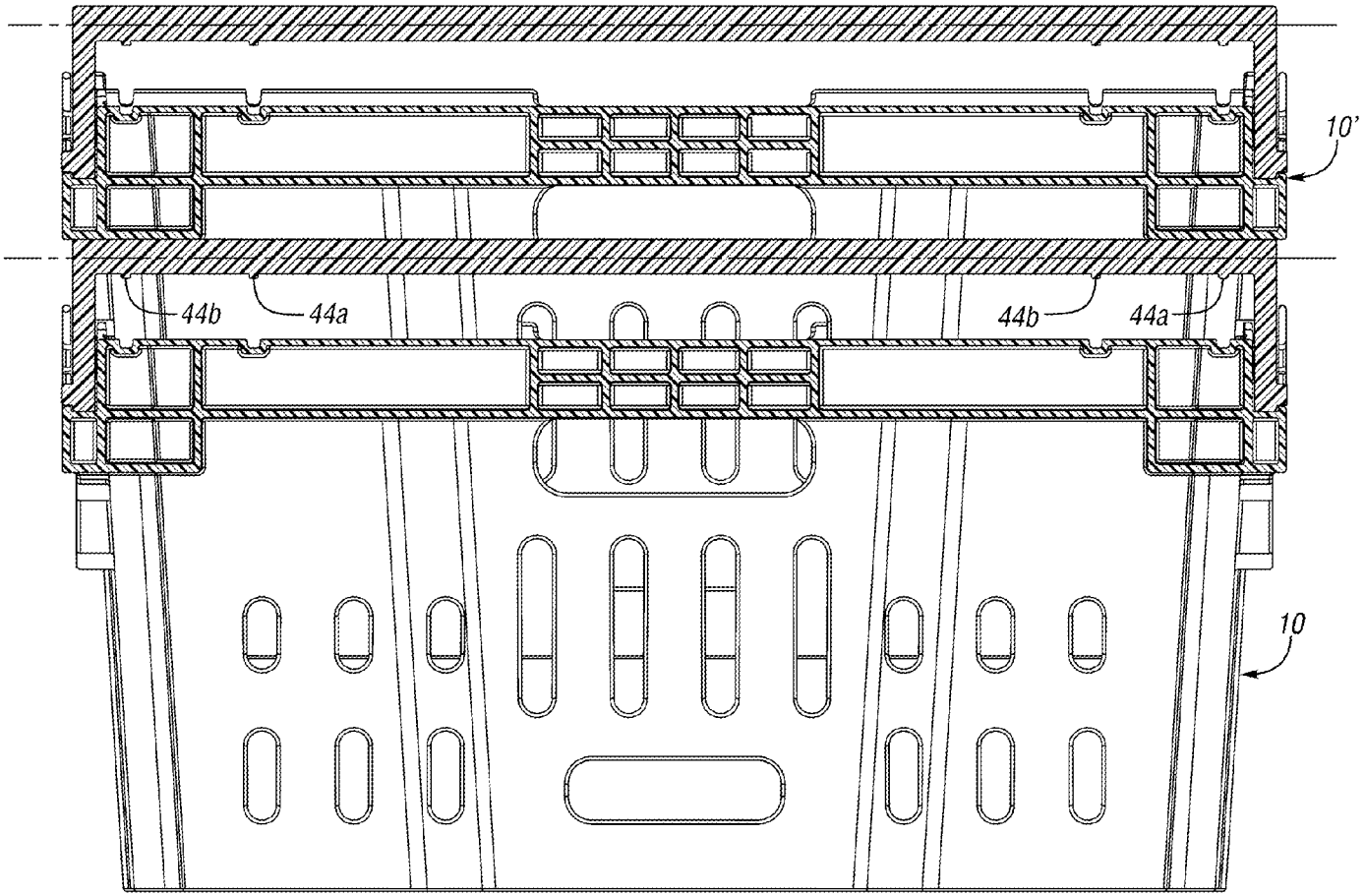
FIG. 4 is a sectional view taken through the bail members of the containers of FIG. 1.

The inner and outer interlocking projections 44*a-b* are positioned such that they project upwardly from the support portion 19 only in certain rotational positions of the bail member 18. For example, in the high nest position as shown in FIGS. 1-4, it can be seen in FIGS. 2-4 that the inner and outer interlocking projections 44*a-b* do not extend upwardly from the upper surface of the support portion 19, but project outwardly of the container 10. However, as can be seen in FIG. 3, the concave ledges 26' are positioned inwardly of the outer interlocking projections 44*b* and in contact with the outer interlocking projections 44*b* because they are concave and extend downwardly on the outer surface of the support portion 19 of the bail member 18 in the high nest position. The outer interlocking projections 44*b* thus prevent lateral movement of the upper container 10' relative to the lower container 10 in the high nest position.

Figure 5:
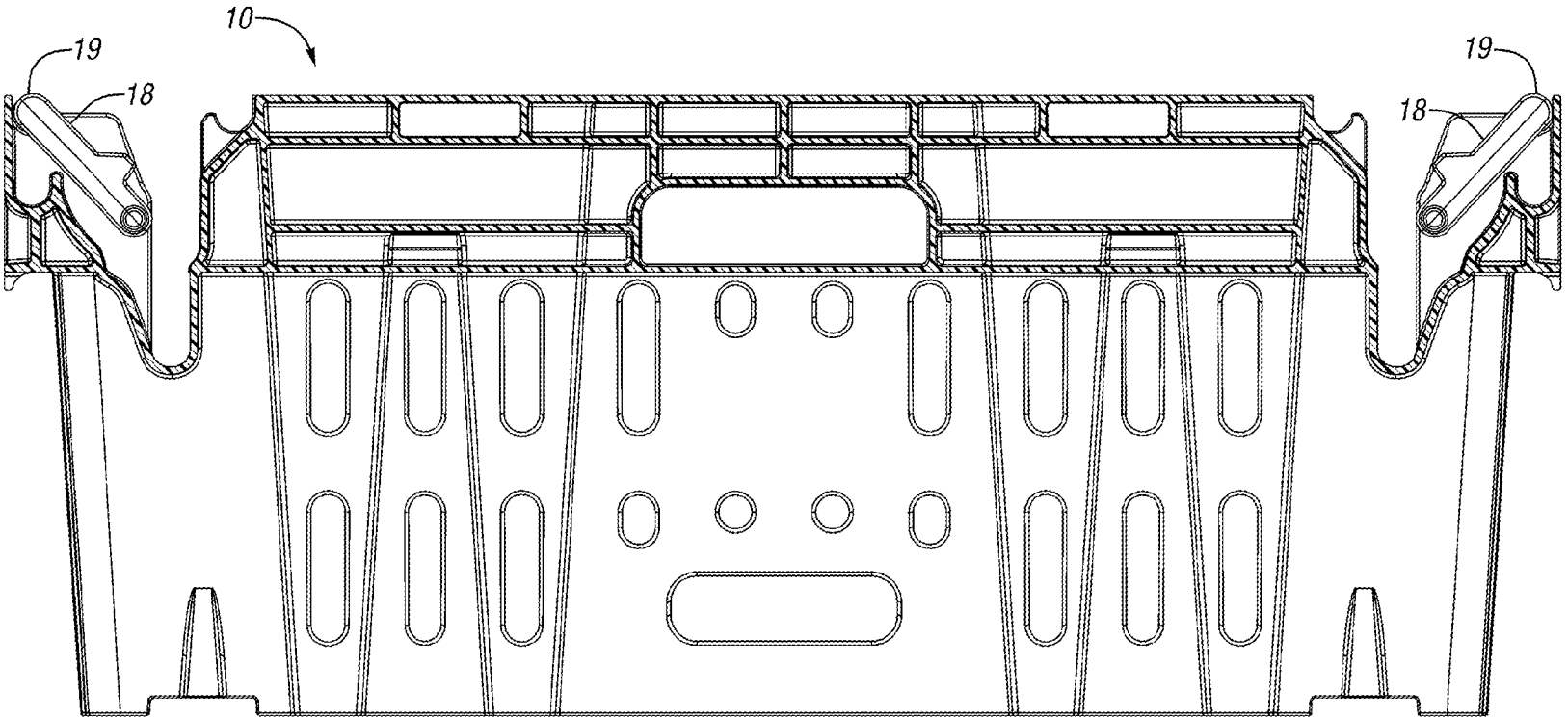
FIG. 5 is a sectional view of the lower container of FIG. 1 with the bail members in a low nest position.

FIG. 5 is a sectional view of the lower container 10 of FIG. 1 with the bail members in a low nest position. In this position, a similar container 10' (not shown in FIG. 5) can fully nest in the lower container 10 to the point where the ledges 25', 26' rest on the end walls 16 and side walls 14, respectively, of the lower container 10.

Figure 6:
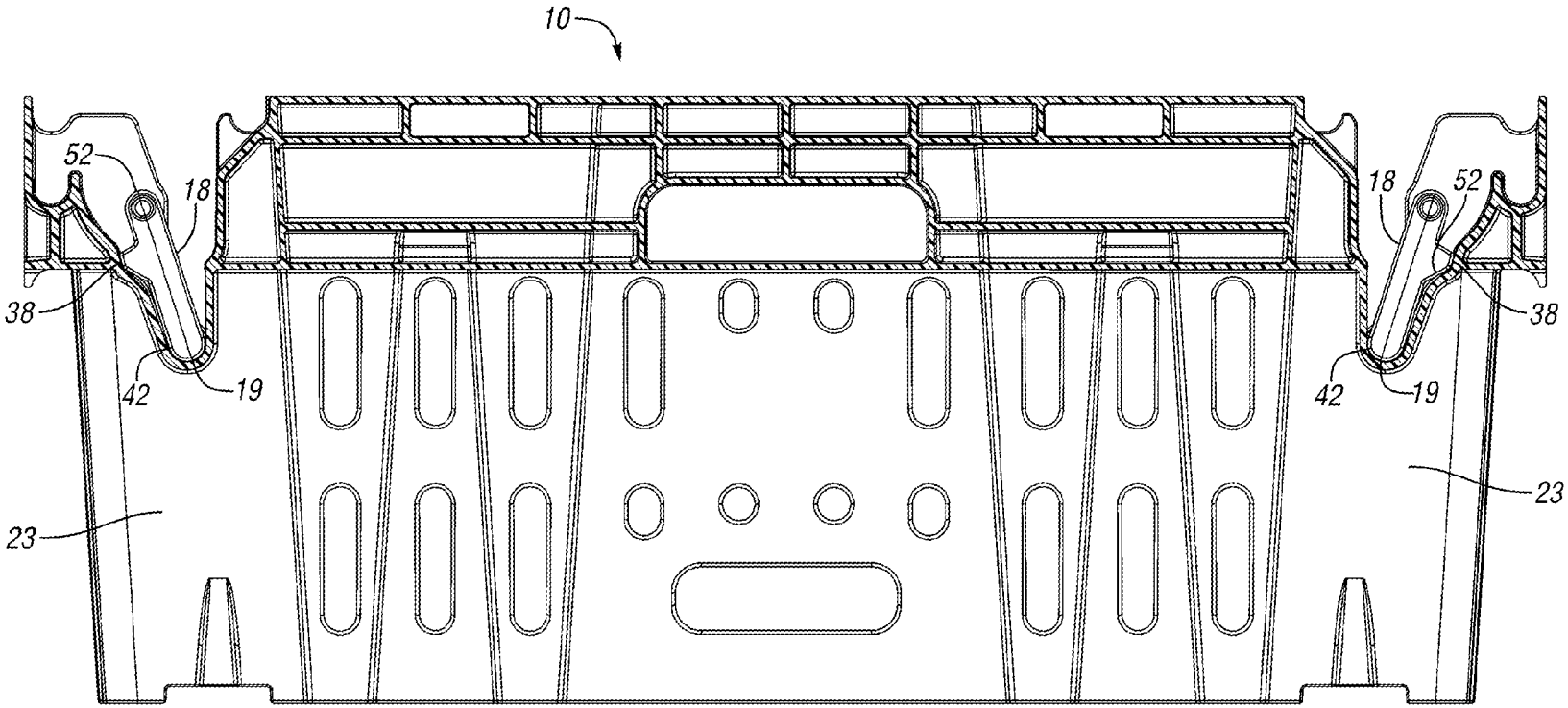
FIG. 6 is a sectional view of the lower container of FIG. 1 with the bail members in a low stack position.
Figure 7:
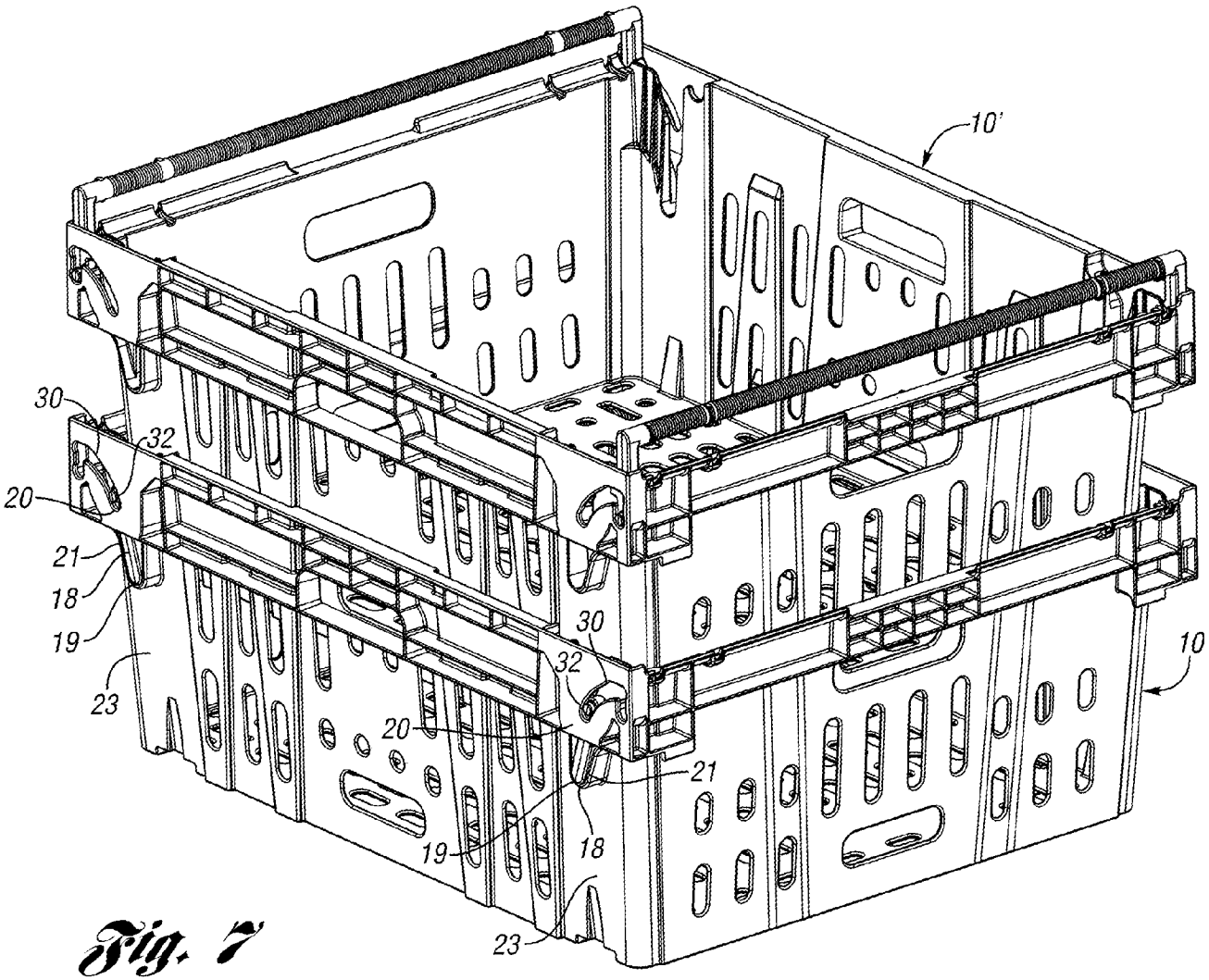
FIG. 7 is a perspective view of the containers of FIG. 1 with the bail members of the lower container in the low stack position.
Figure 8:
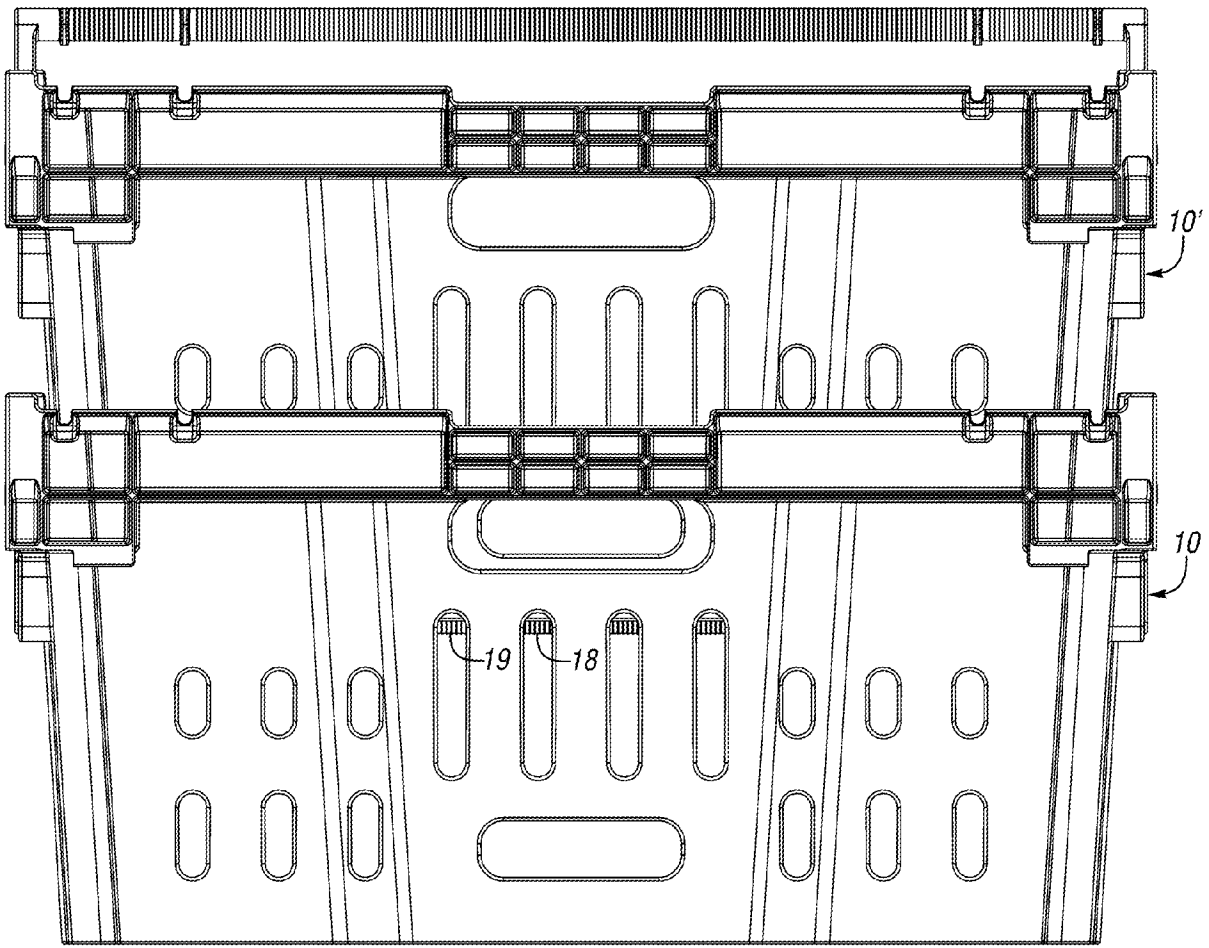
FIG. 8 is a side view of the containers of FIG. 7.
Figure 9:
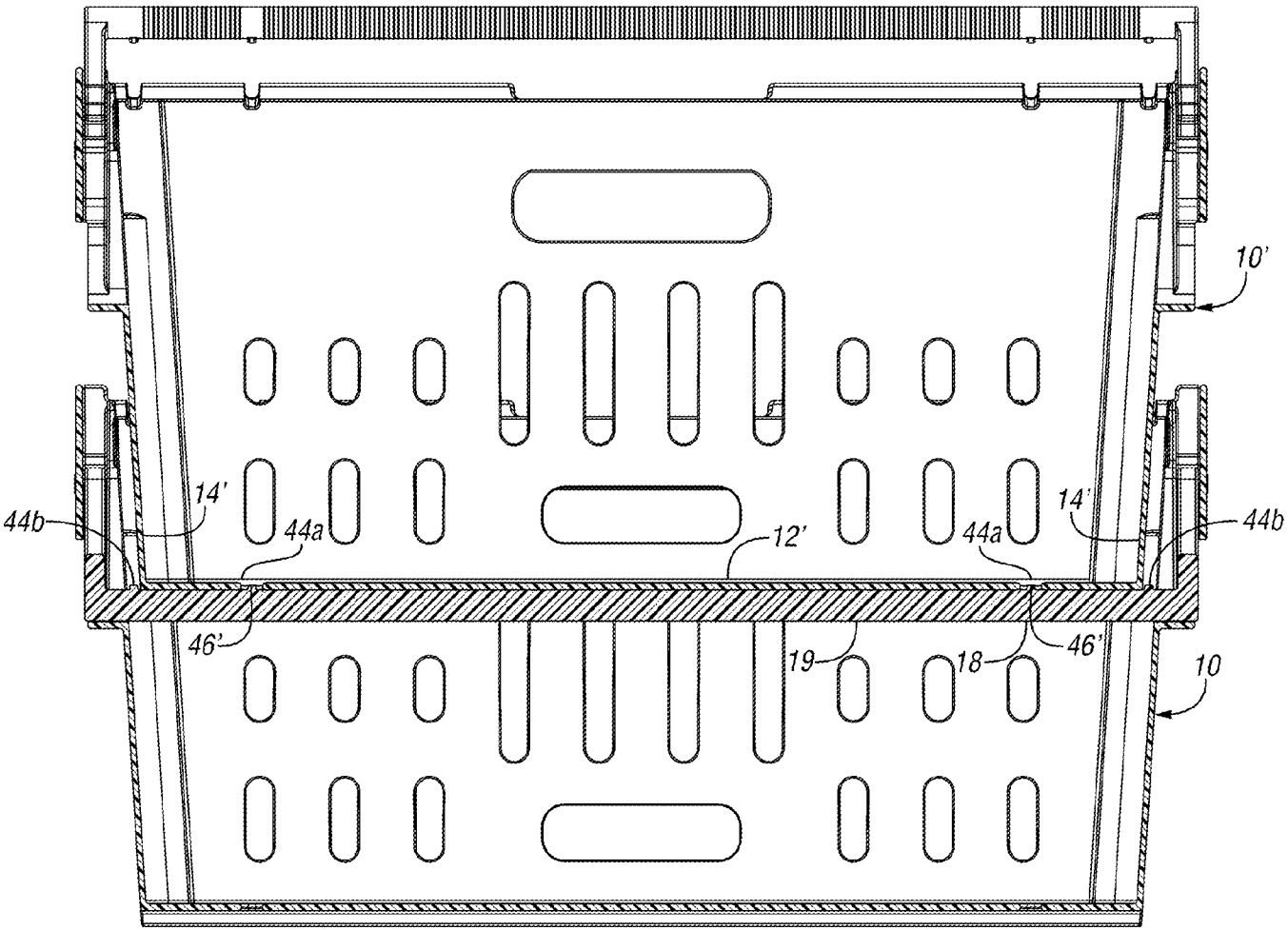
FIG. 9 is a sectional view, taken through the bail member of the lower container, of the containers of FIG. 7.

FIG. 6 is a sectional view of the lower container of FIG. 1 with the bail members 18 in a low stack position on the lower support rests 42 on the inner wall portions 23. The lower support rests 42 are notches formed in the inner wall portion 23 to impede movement of the bail member 18 out of the selected position. The lateral projections 38 are also interlocked within a recess 52 between the inner and outer wall portions 23, 20 to increase stability of the bail member 18. FIGS. 7-9 show the containers of FIG. 1 with the bail members 18 of the lower container 10 in the low stack position. The upper container 10' is supported above the floor 12 by the bail member 18 in the notch 17' of the upper container 10' to create a middle-sized storage area between the floors 12, 12' that is larger than that provided by the high and low nest positions, but smaller than that provided by the high stack position. The arms 21 of the bail members 18 are received between the inner wall portions 23 and outer wall portions 20. The inner and outer wall portions 23, 20 prevent contact with the arm 21 by users or by other containers or objects, which prevents the pin 32 from being knocked out of the pin opening 30 when the bail members 18 are in the lower stack position.

Referring to FIG. 9, the floor 12' and bottom edges of end walls 16 rest on the bail members 18 between the outer interlocking projections 44*b* on the support portion 19 of the bail members 18. The inner interlocking projections 44*a* on the support portion 19 are received in small recesses 46' formed in the bottom of the floor 12'. The interlocking of the inner and outer interlocking projections 44*a-b* with the floor 12', end walls 16' and recesses 46' prevent lateral movement of the upper container 10' when stacked on the bail members 18 of the lower container 10 when the bail members 18 are in certain of the multiple positions. Alternatively, the interlocking members, i.e. the recesses 46' and the interlocking projections 44*a-b* could be switched, such that the recesses 46' are on the bail members 18 and the interlocking projections 44*a-b* are on the bottom of the floor 12.

Figure 10:
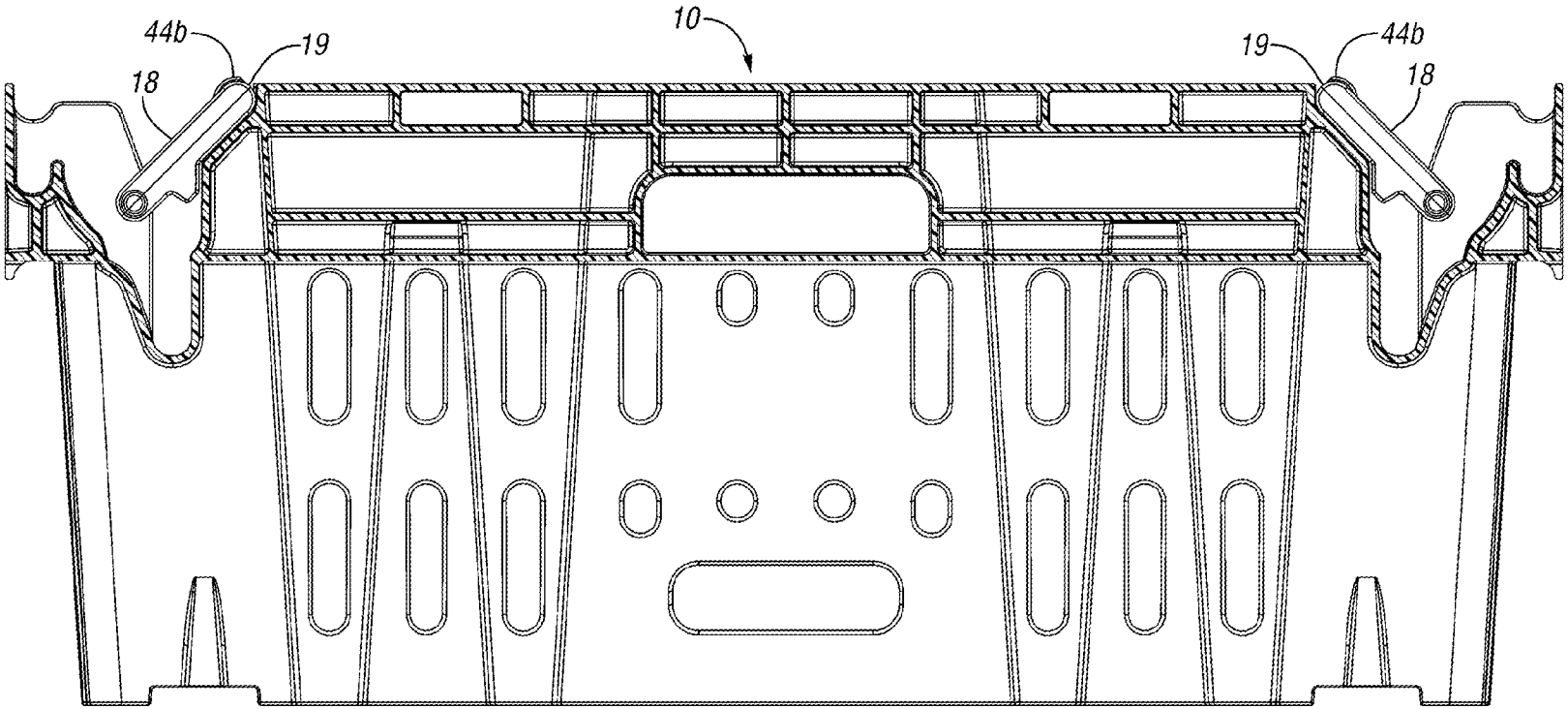
FIG. 10 is a sectional view of the lower container of FIG. 1 with the bail members in a high stack position.
Figure 11:
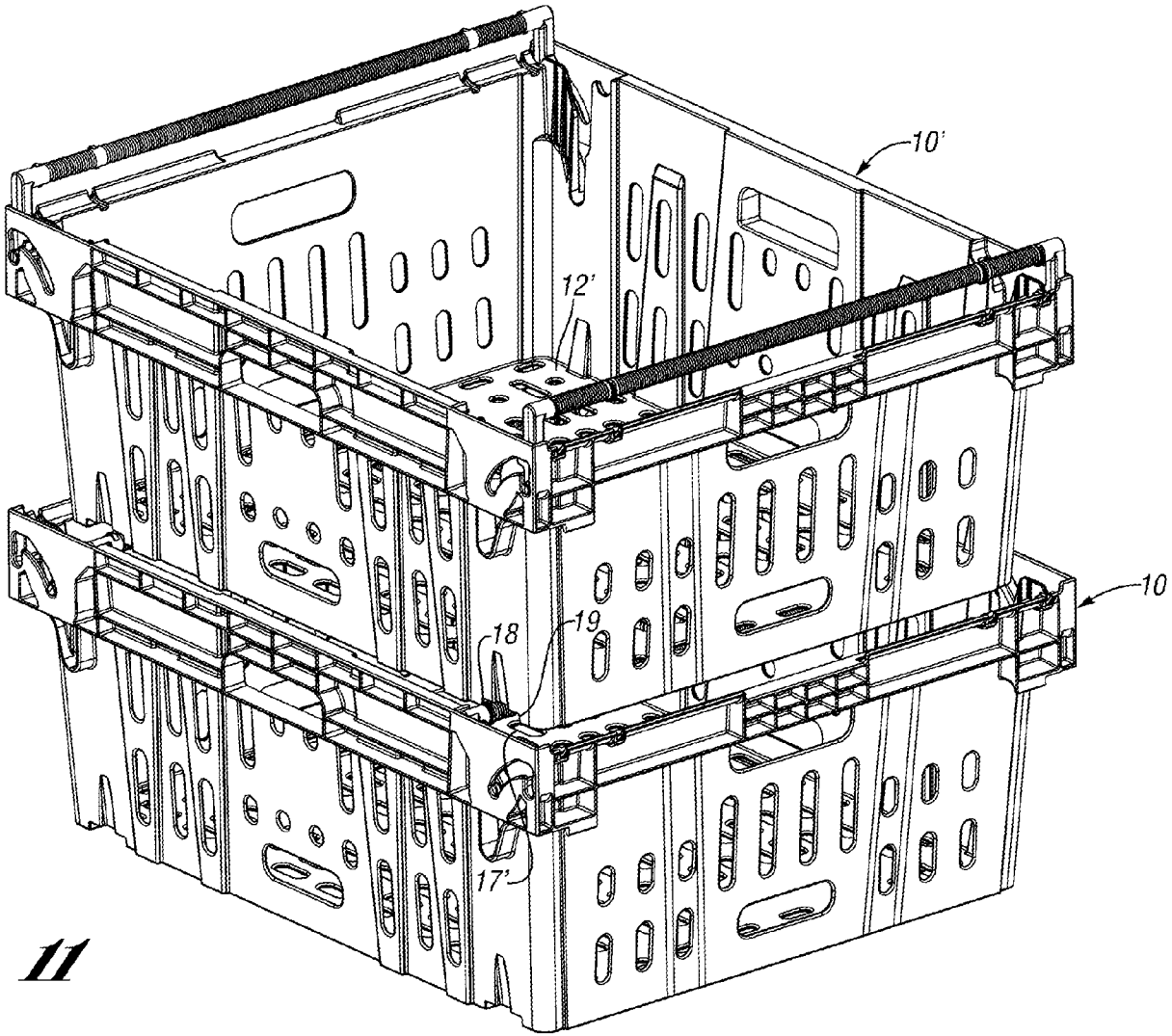
FIG. 11 is a perspective view of the containers of FIG. 1 with the bail members of the lower container in the high stack position.
Figure 12:
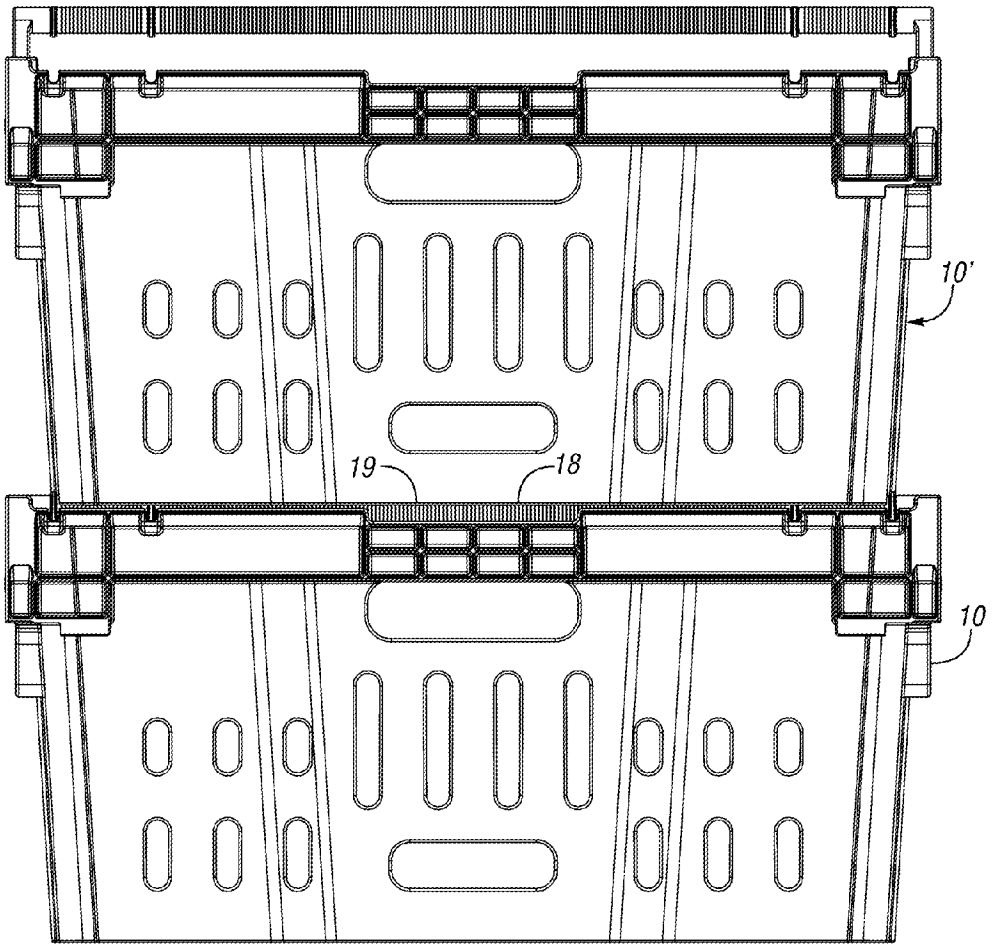
FIG. 12 is side view of the containers of FIG. 11.
Figure 13:
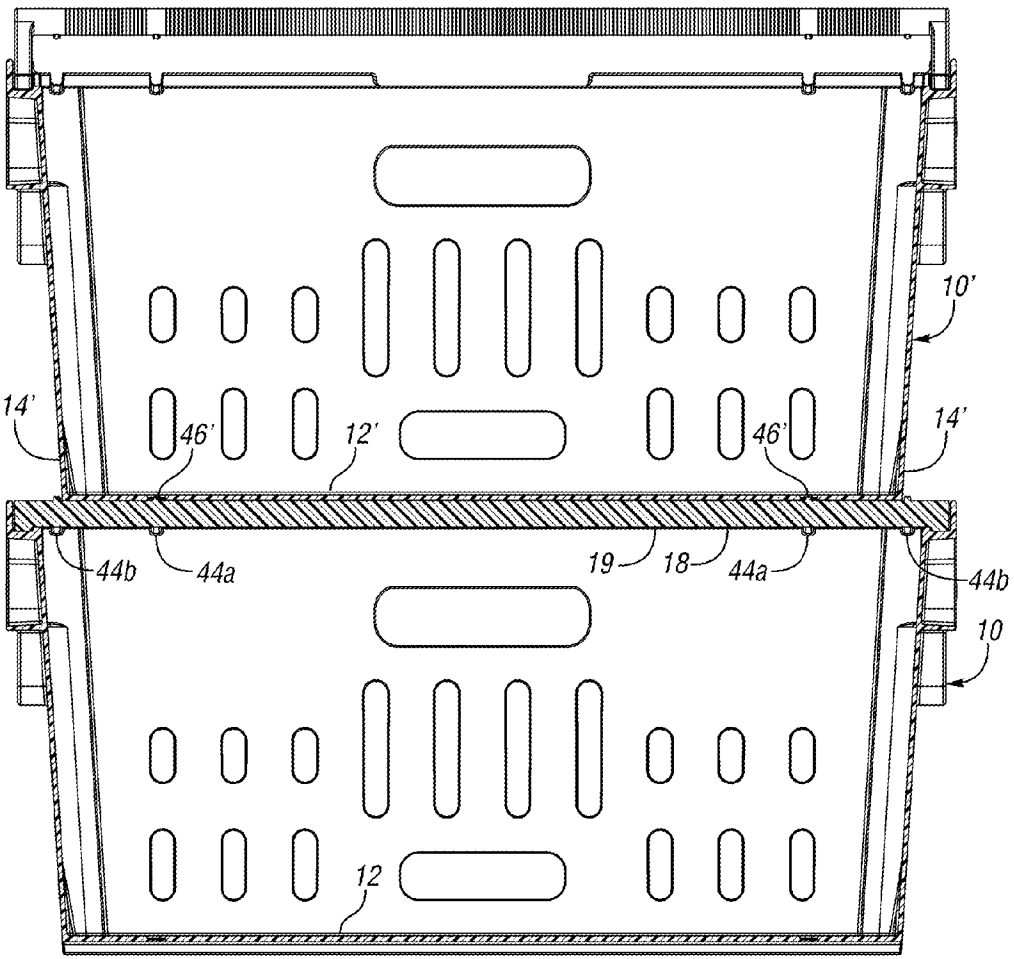
FIG. 13 is a sectional view, taken through the bail member of the lower container, of the containers of FIG. 11.

FIG. 10 is a sectional view of the lower container 10 of FIG. 1 with the bail members 18 in a high stack position. FIGS. 11-13 show the containers 10, 10' of FIG. 1 with the bail members 18 of the lower container 10 in the high stack position. The support portion 19 of the bail member 18 of the lower container 10 is received in the notches 17' of the upper container 10' such that the floor 12' of the upper container 10' is supported by the bail members 18. This position provides the maximum storage capacity in the container 10 and transfers load to the bail members 18, thus keeping the weight of the upper container 10' off the contents of the lower container 10. As shown in FIG. 13, the floor 12' and bottom edges of end walls 16 rest on the bail members 18 between the outer interlocking projections 44*b* on the support portion 19 of the bail members 18. The inner interlocking projections 44*a* on the support portion 19 are received in small recesses 46' formed in the bottom of the floor 12'. The interlocking of the inner and outer interlocking projections 44*a-b* with the floor 12', end walls 16' and recesses 46' prevent lateral movement of the upper container 10' when stacked on the bail members 18 of the lower container 10 when the bail members 18 are in this high stack position.

Two containers 110, 110' according to a second embodiment of the present invention is shown in FIGS. 14-22. Components corresponding to those in the first embodiment are given a similar reference numeral, preappended with the numeral "1." Corresponding components of the upper container 110' are designated with the prime notation. The container 110 includes side walls 114 and end walls 116 extending upwardly from a floor 112. End walls 116 include outer wall portions 120 and inner wall portions 123. Pin openings 130 are formed in the outer wall portions 123 and receive the pins 132 of the bail members 118. The side walls 114 include ledges 126 protruding outwardly from the side walls 114 at a height even with the ledges 125 on the end walls 116. The ledges 126 on the side walls 114 include concave lower recesses 128 formed along their length. The support portions 119 of the bail members 118 have a single pair of interlocking projections 144 spaced proximate outer ends of the support portion 119. Each bail member 118 includes a plurality of circumferential molded micro-ribs 122 on the support portion 119.

Figure 17:
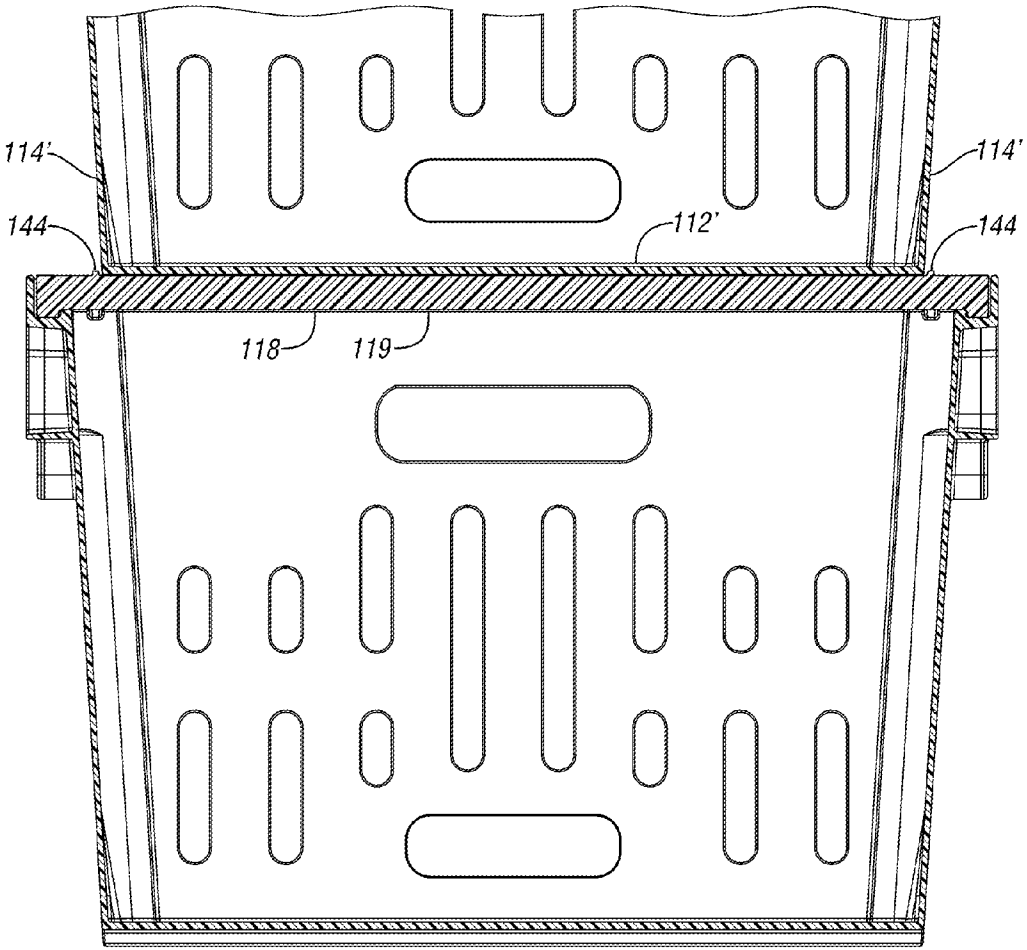
FIG. 17 is a sectional view taken through the bail member of the lower container of FIG. 16.

In FIGS. 14-17, the bail members 118, 118' are shown in the upper stack position with the support portions 119 of the bail members 118 supported on support rests 136. In this position, the floor 112' of a similar container 110' is supported in notches 117' on the bail members 118 at a maximum height above the floor 112, as shown in FIG. 17. The floor 112' and bottom edges of end walls 116' rest on the bail members 18 between the outer interlocking projections 44*b* on the support portion 119 of the bail members 118. The interlocking projections 144 on the support portion 119 are received in small recesses 146' formed in the bottom of the floor 112'. The interlocking of interlocking projections 144 with the floor 112', end walls 116' and recesses 146' prevent lateral movement of the upper container 110' when stacked on the bail members 118 of the lower container 110 when the bail members 118 are in this high stack position.

Figure 15:
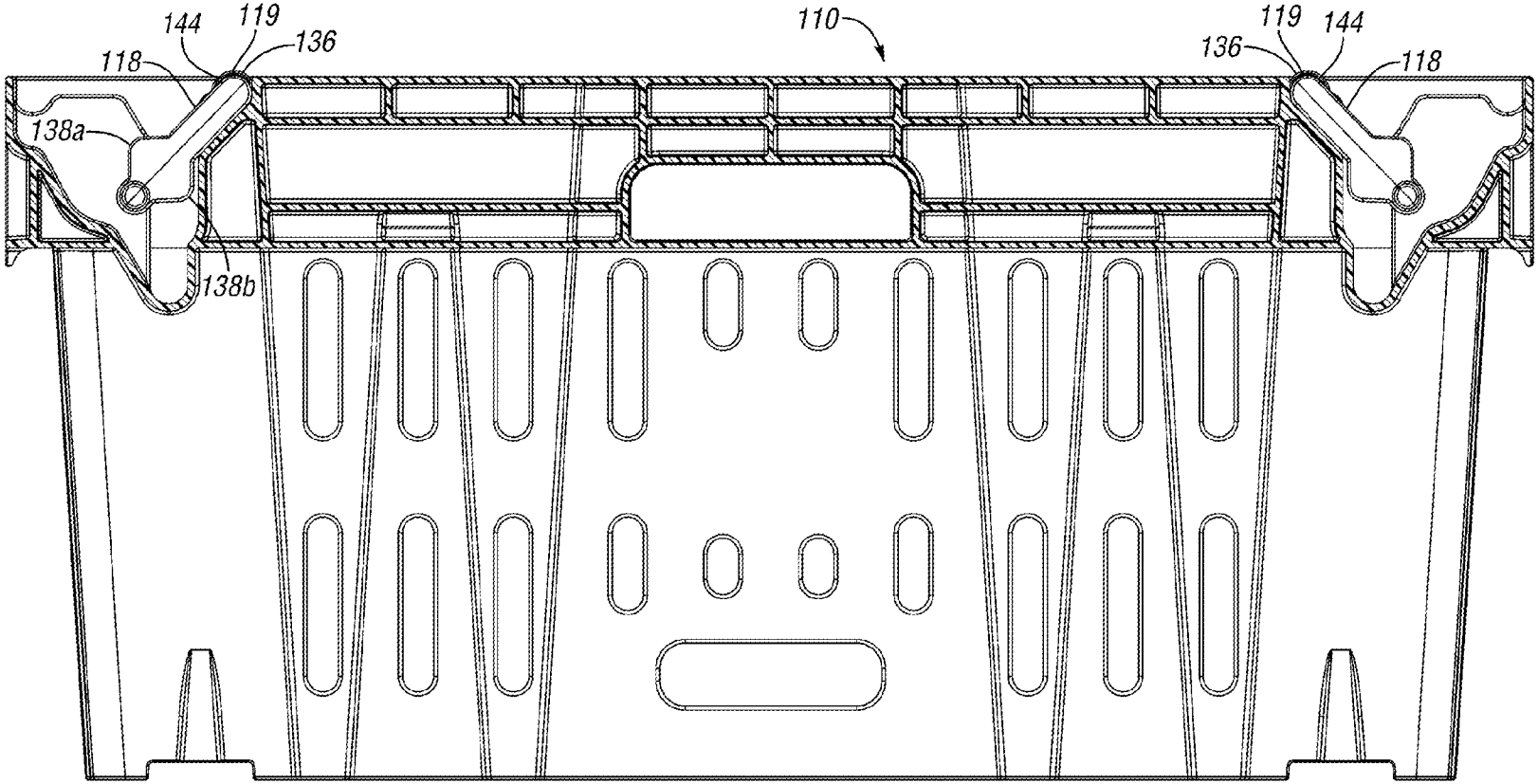
FIG. 15 shows a sectional view of the lower container of FIG. 14, with the bail members in the high stack position.
Figure 16:
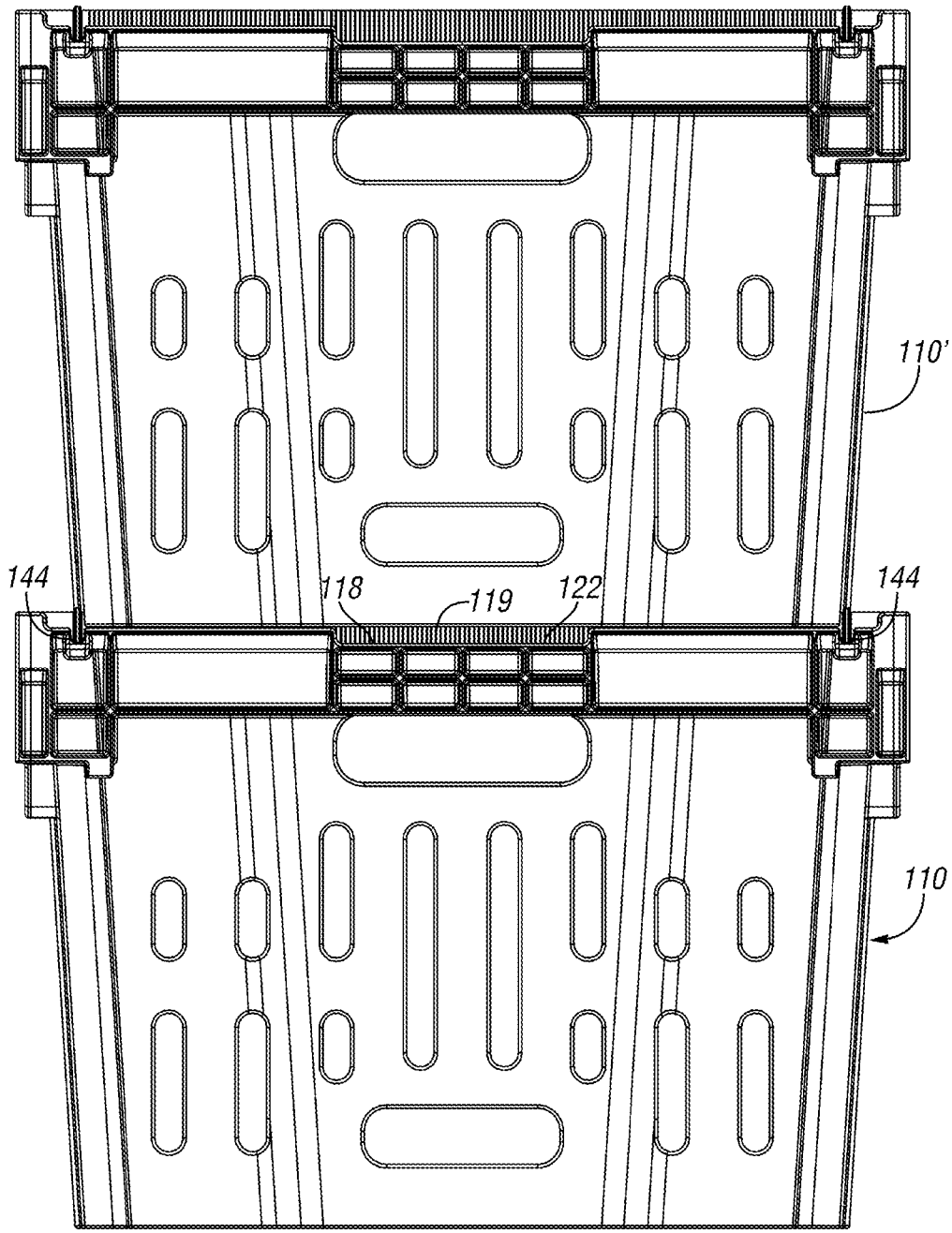
FIG. 16 is a side view of the containers of FIG. 14.

Referring to FIG. 15, the arms 119 of the bail members 118 include a pair of lateral projections 138*a-b* that interlock within recesses and contours between the inner and outer wall portions 123, 120 in the various positions of the bail members 118 to increase stability of the bail members 118.

Figure 18:
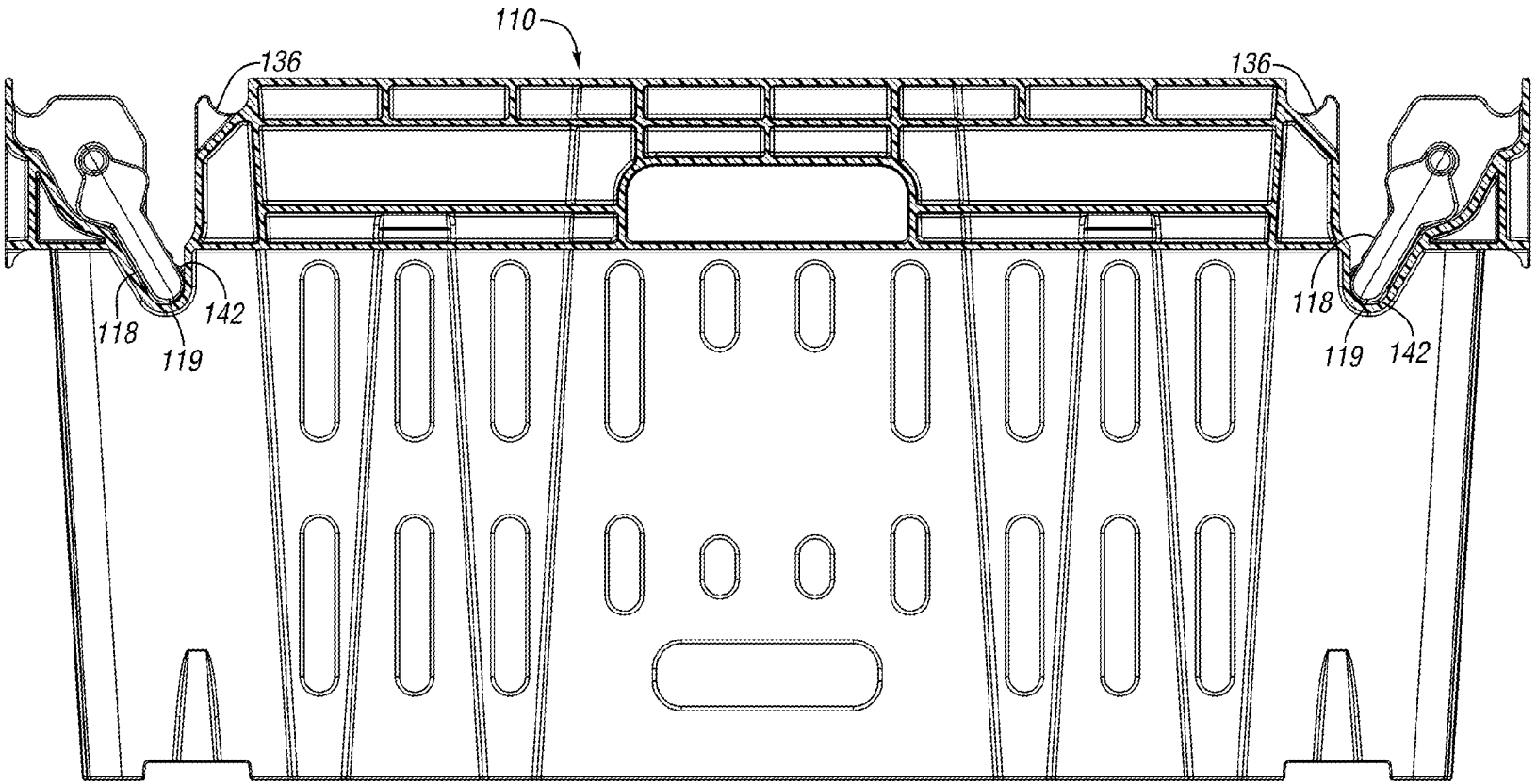
FIG. 18 is a sectional view of the lower container of FIG. 14 with the bail members in a low stack position.
Figure 19:
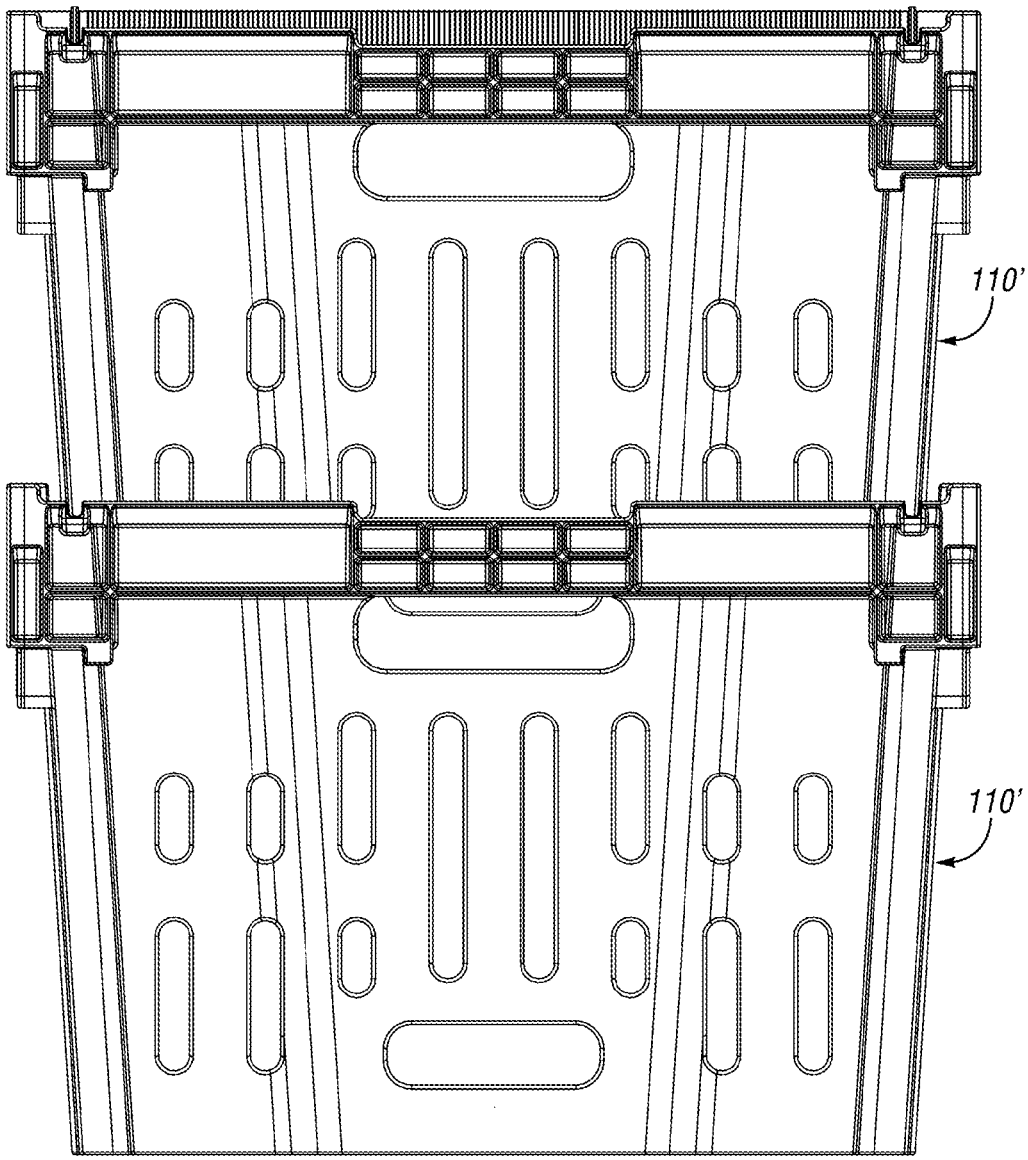
FIG. 19 is a side view of the containers of FIG. 14 with the bail members of the lower container in the low stack position.
Figure 20:
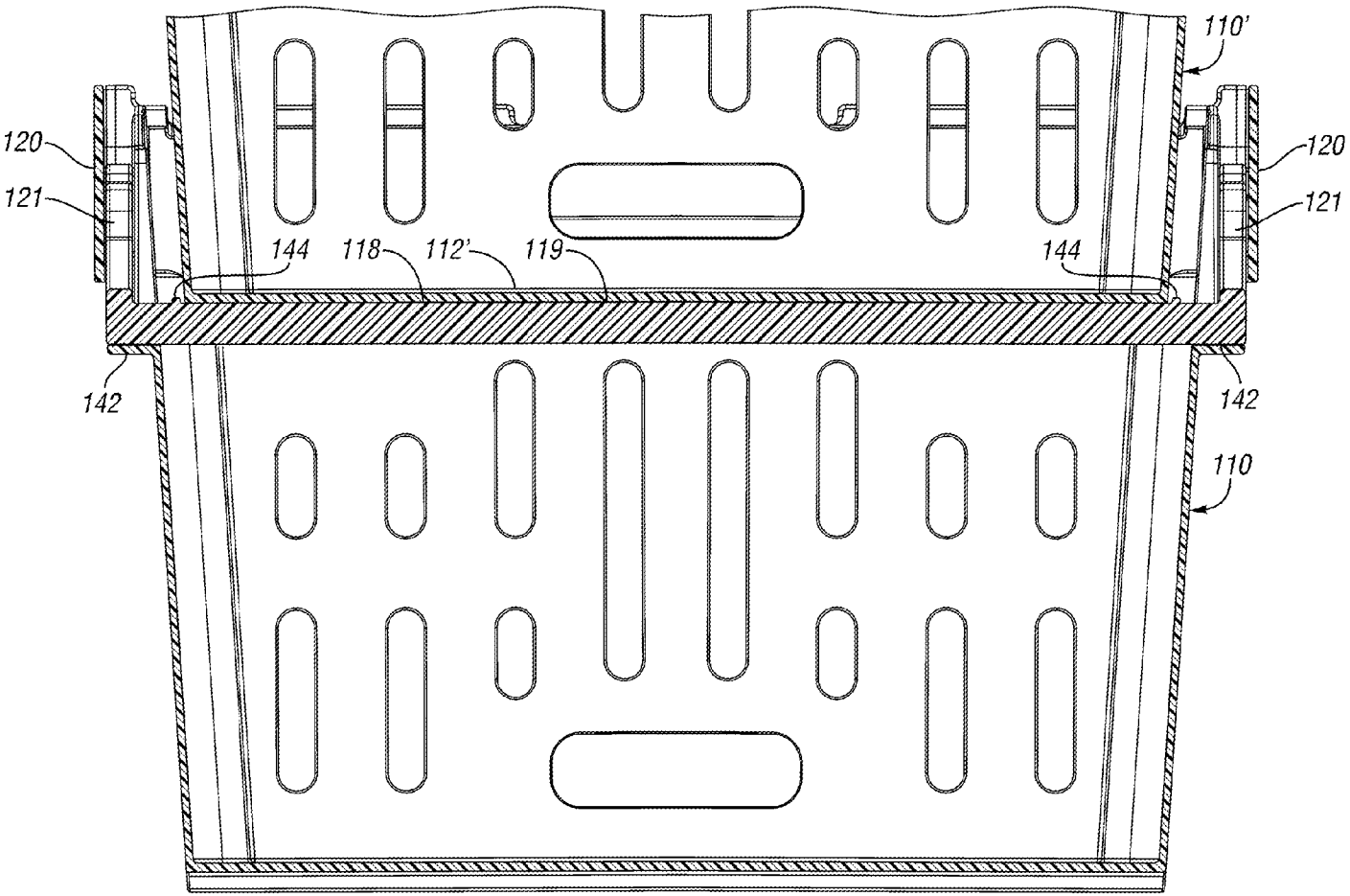
FIG. 20 is a sectional view taken through the bail member of the lower container of FIG. 19.

In FIGS. 18-20, the bail members 118 are shown in the low stack position with the support portions 119 of the bail members 118 supported on the support rests 142. In this position, the floor 112' of a similar container 110' is supported on the bail members 118 above the floor 112, and the upper container 110' partially nests within the container 110 without putting contacting the contents of the container 110. As shown in FIG. 19, the floor 112' and bottom edges of end walls 116' rest on the bail members 18 between the interlocking projections 44 on the support portion 119 of the bail members 118. The interlocking of the interlocking projections 144 with the floor 112' and end walls 116' prevents lateral movement of the upper container 110' when stacked on the bail members 118 of the lower container 110 when the bail members 118 are in this low stack position.

Figure 14:
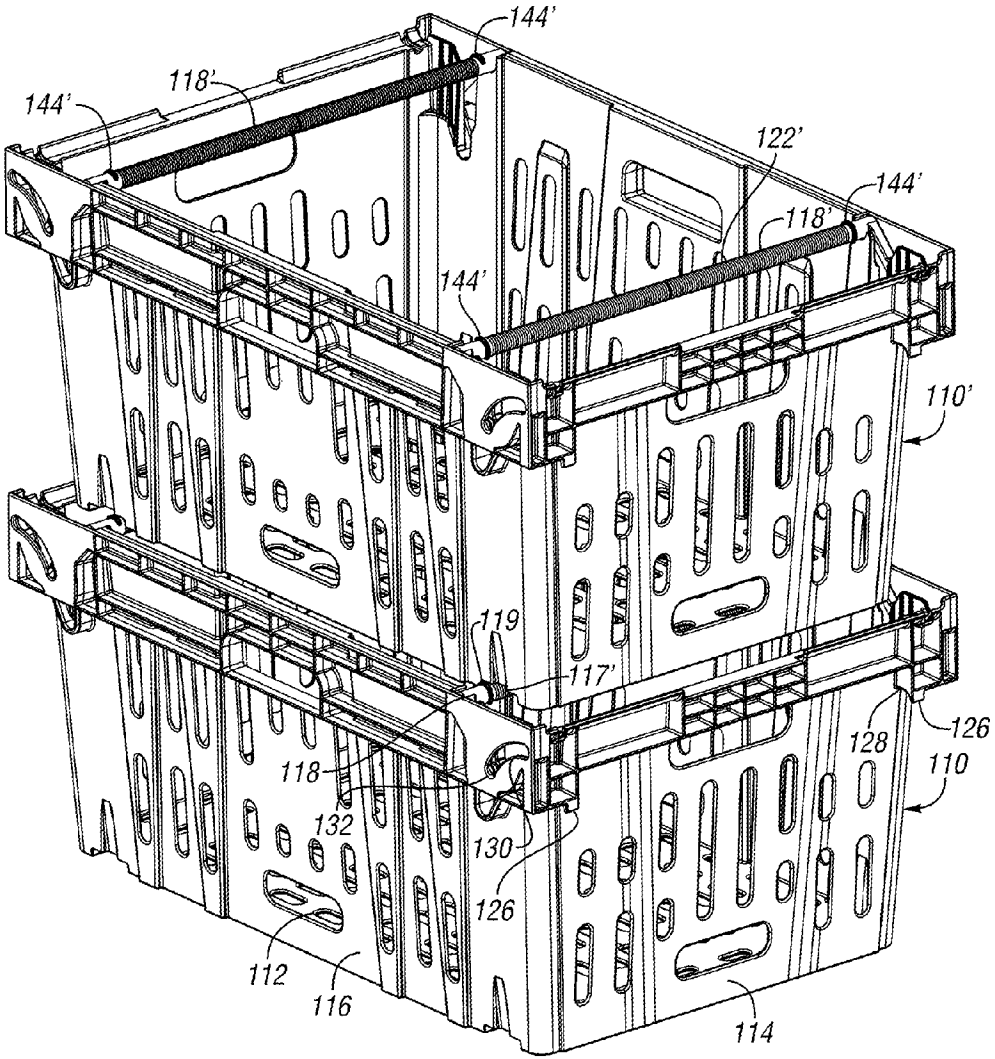
FIG. 14 is a perspective view of a container according to a second embodiment of the present invention having bail members in a high stack position and a similar container stacked thereon.
Figure 21:
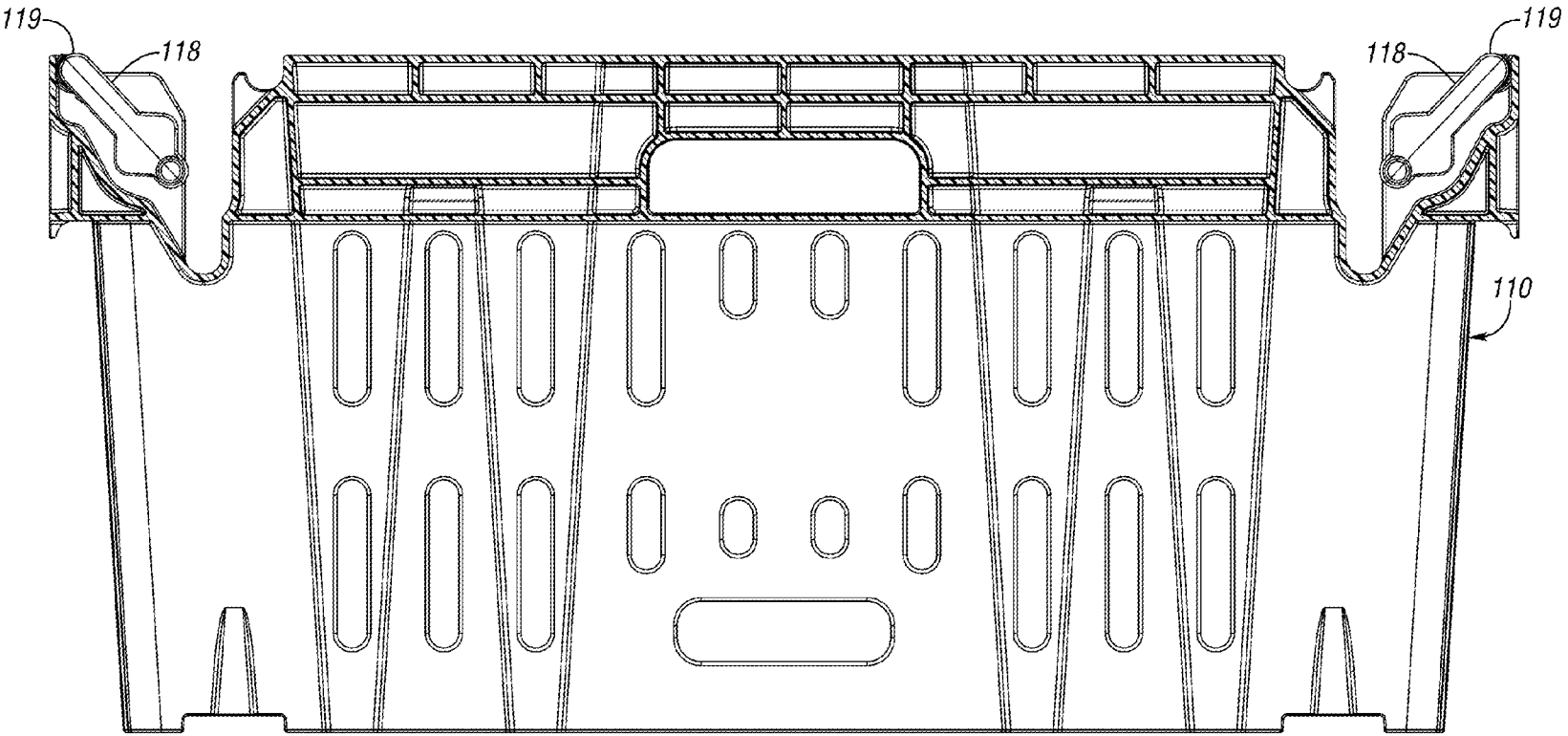
FIG. 21 is a sectional view of the lower container of FIG. 14 with the bail members in a low nest position.
Figure 22:
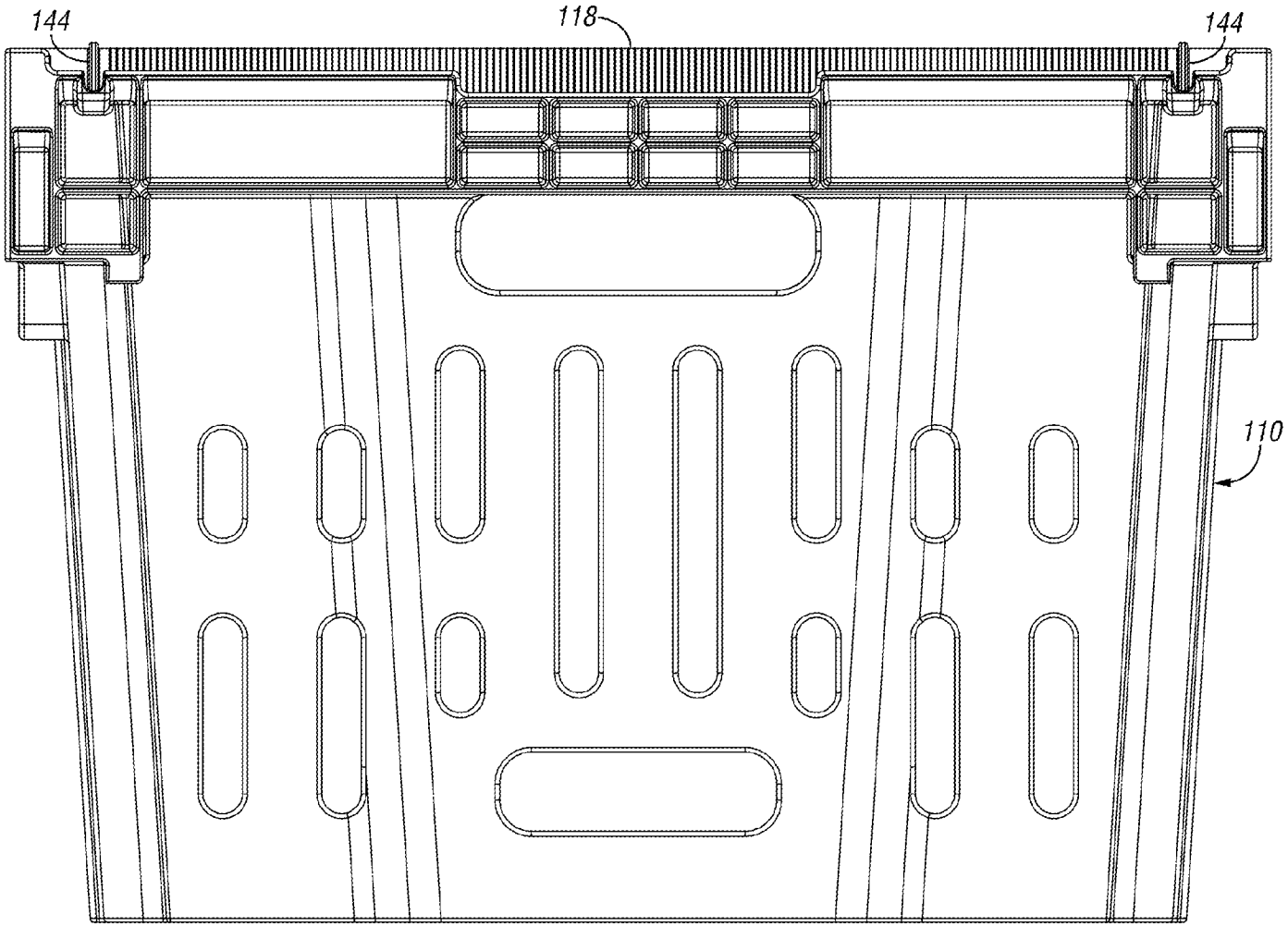
FIG. 22 is a side view of the container of FIG. 21.

FIG. 21 is a sectional view of the lower container 110 of FIG. 14, with the bail members 118 in the low nest position, with the support portion 119 of the bail members 118 vertically aligned outwardly of the floor 112. This permits the full nesting of the upper container 110' (not shown in FIG. 21) to the point where the ledges 125', 126' rest on the end walls 116 and side walls 114, respectively, of the lower container 110. FIG. 22 is a side view of the container 110.

In both embodiments, the walls and floor of the container 10, 110 are integrally molded as a single unitary structure from a plastic material such as polypropylene or may also be HDPE, or other suitable materials, via an injection molding or other suitable process. The bail members 18, 118 may be formed of any suitable material, but are preferably injection molded from 50% glass-filled nylon or other composite material, but could also be steel. The container 10 of FIGS. 1-13 and the container 110 of FIGS. 14-22 are also designed to be stacked together as shown in FIGS. 23-31. In the embodiments shown, the container 10 is 24 inches by 20 inches, while the container 110 is 24 inches by 16 inches. Of course, other sizes would be within the scope of the present invention, but these sizes are used for purposes of illustration below.

Figure 23:
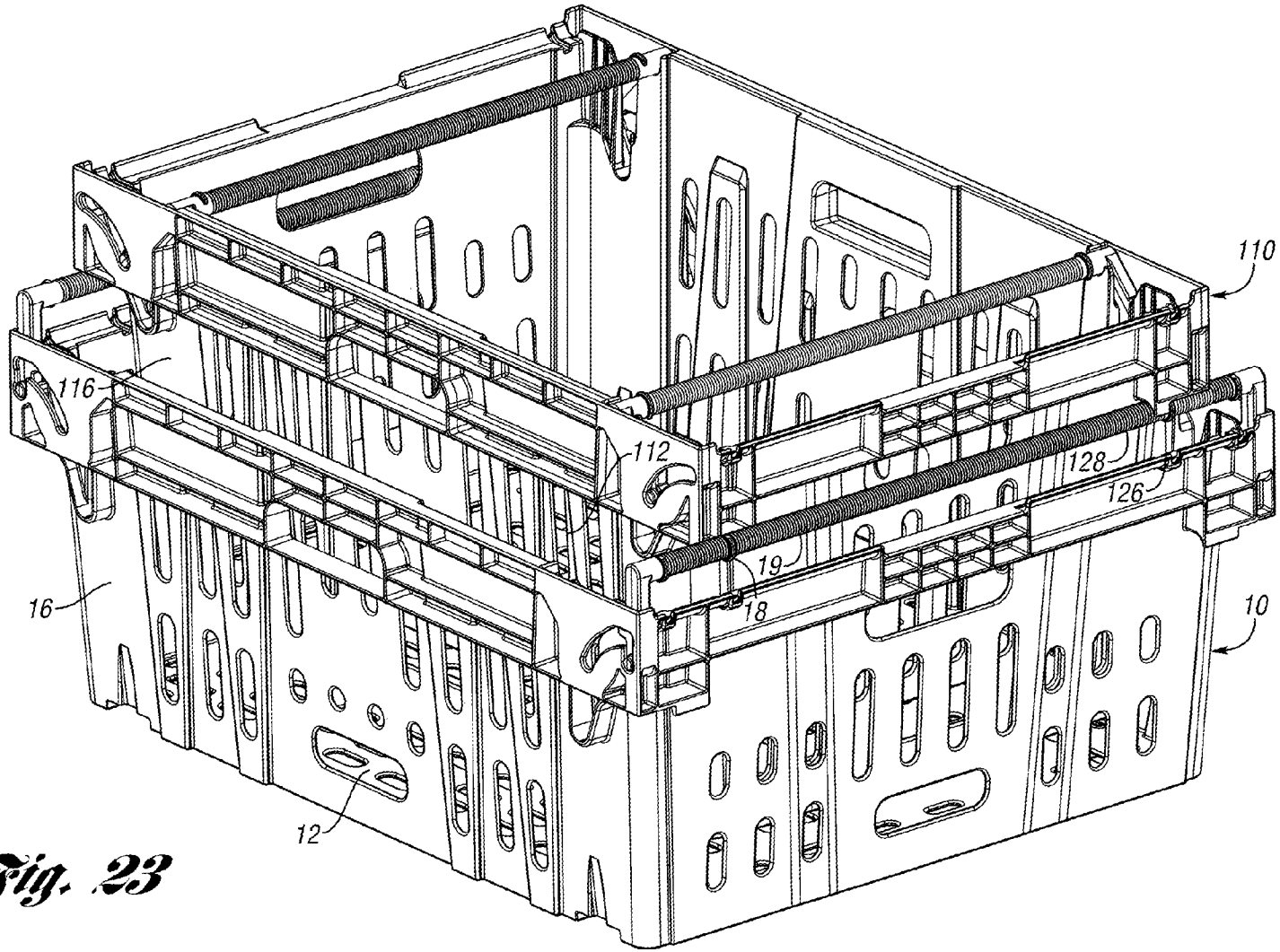
FIG. 23 is a perspective view of the container of FIGS. 4-22 stacked on the container of FIGS. 1-13, with the bail members of the lower container in the high nest position.
Figure 24:
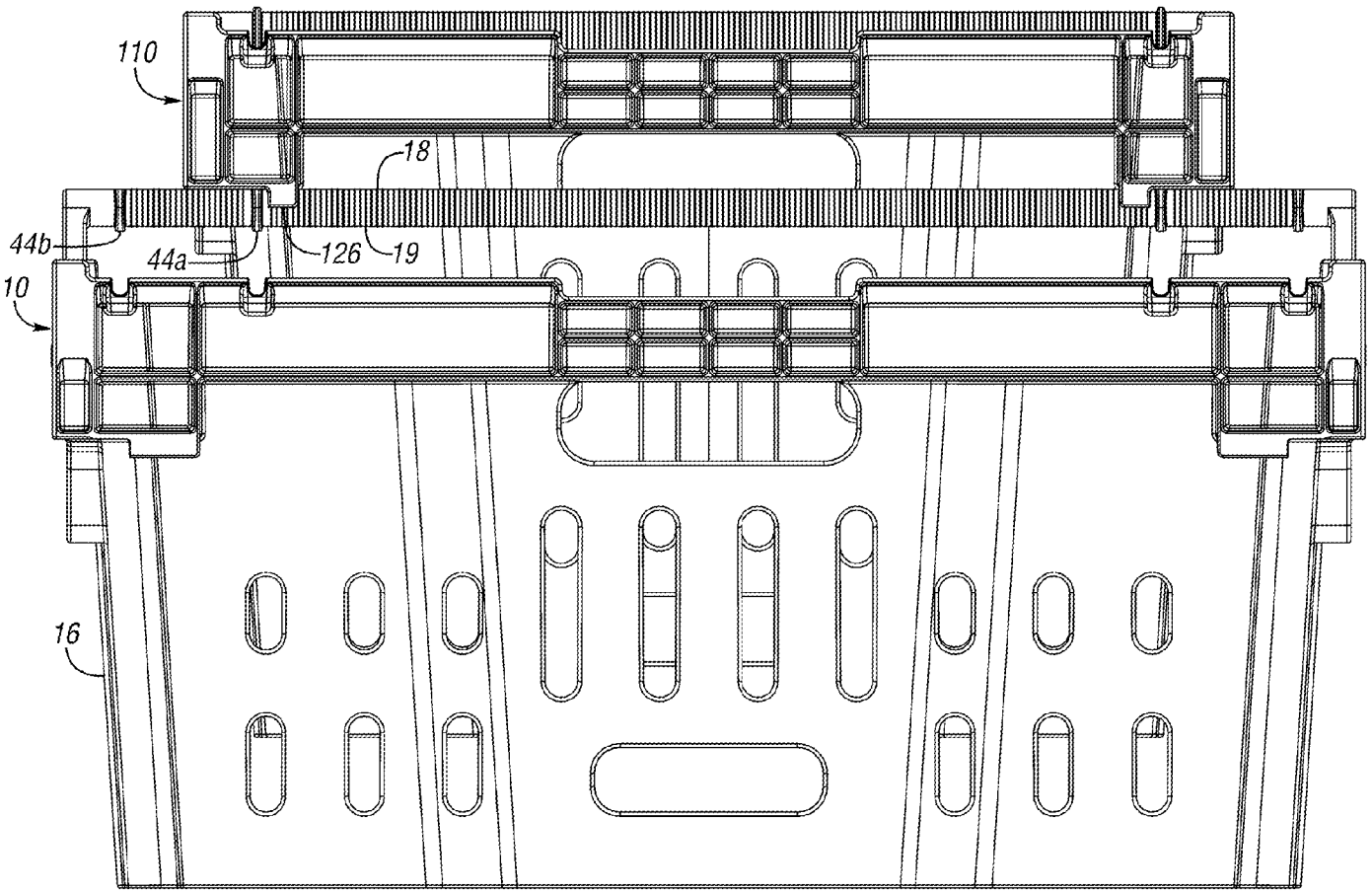
FIG. 24 is a side view of the containers of FIG. 23.
Figure 25:
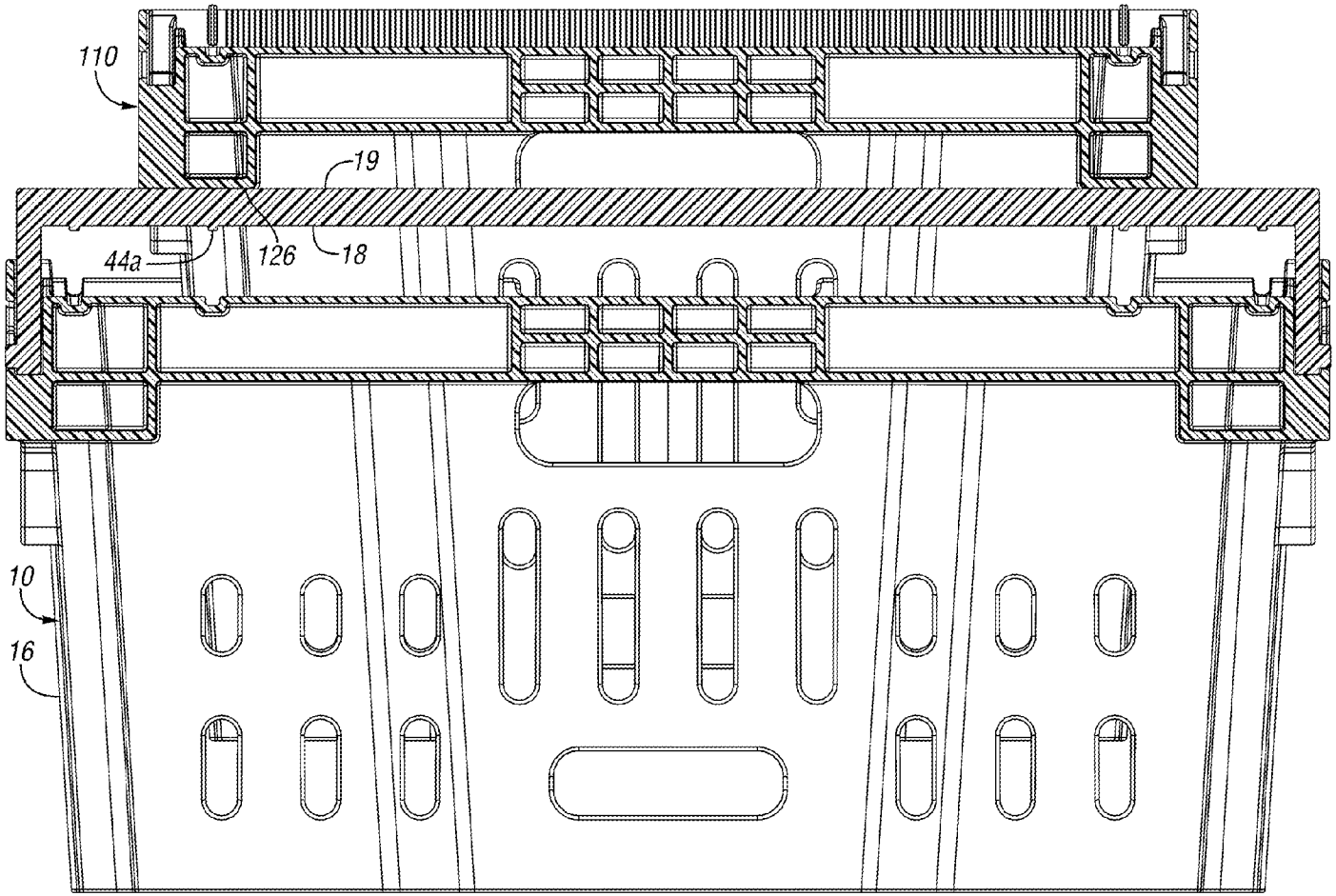
FIG. 25 is a sectional view of the containers of FIG. 24 taken through a bail member of the lower container.

In FIGS. 23-25, the bail member 18 of the lower container 10 is in the high nest position, such that the support portion 19 of the bail member 18 is spaced above the uppermost edges of the side walls 14 and end walls 16. The support portion 19 is received within the recess 128 on the ledge 126 of the upper container 110 to support the container 110 partially nested within the container 10, thereby protecting the contents of the lower container 10 between floors 12, 112 while efficiently stacking the containers 10, 110. It should be noted that, in embodiments having the dimensions stated above, there will be approximately a 2-inch gap between the end walls 116 of the upper container 110 and the end walls 16 of the lower container 10. It can be seen in FIGS. 24 and 25 that the inner and outer interlocking projections 44*a-b* do not extend upwardly from the upper surface of the support portion 19 when rotated to the high nest position, but project outwardly of the container 10. It can also be seen that the inner interlocking projections 44*a* would interfere with the placement of the ledge 126 onto the support portion 19 if they did extend upwardly in this position. However, as can be seen in FIG. 24, the concave ledges 126 are positioned inwardly of the inner interlocking projections 44*a* and in contact with the inner interlocking projections 44*a* because they are concave and extend downwardly on the outer surface of the support portion 19 of the bail member 18 in the high nest position. The inner interlocking projections 44*a* thus prevent lateral movement of the upper container 110 relative to the lower container 10 in the high nest position.

Figure 26:
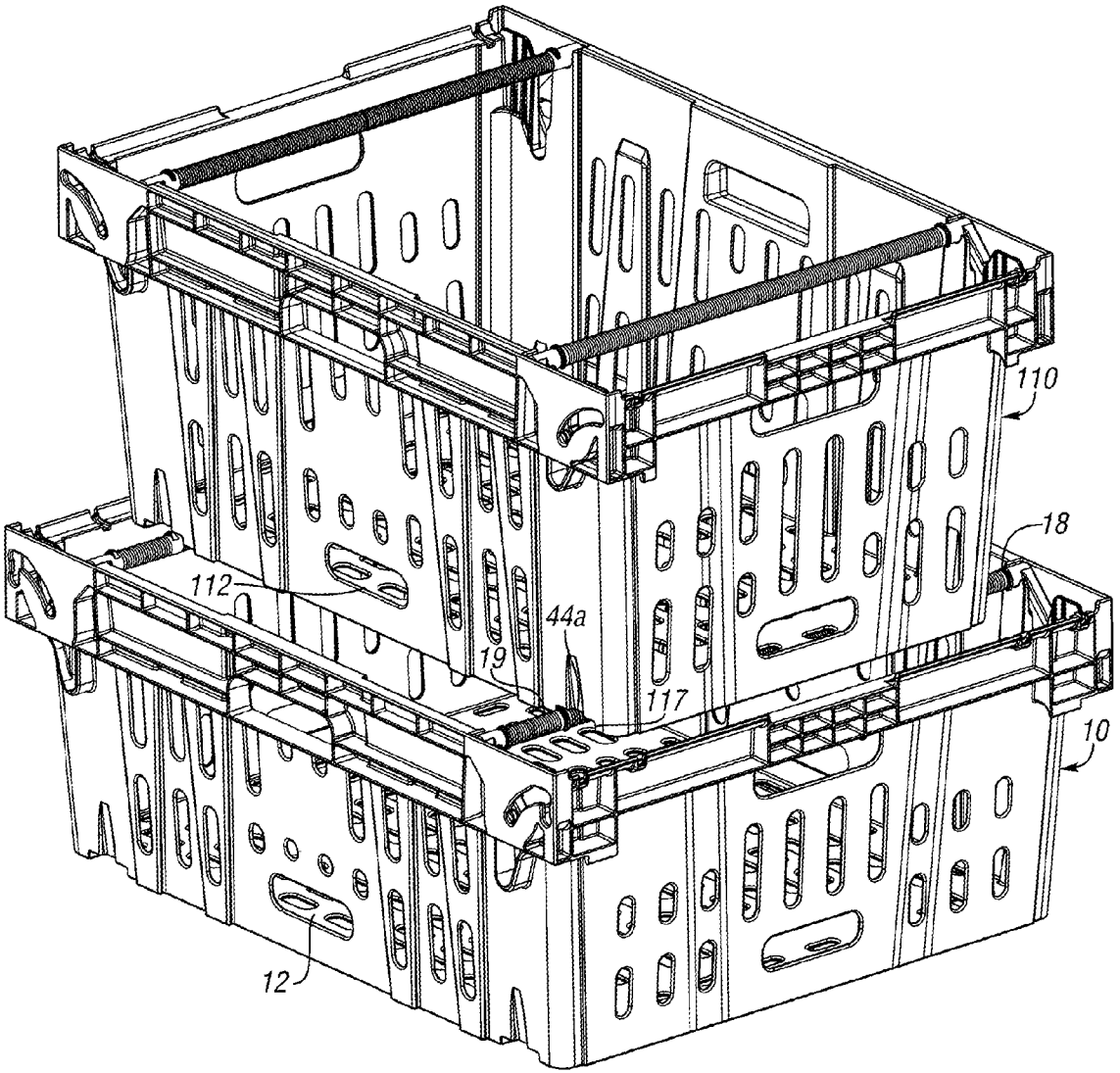
FIG. 26 is a perspective view of the containers of FIG. 23, with the bail members of the lower container in the high stack position.
Figure 27:
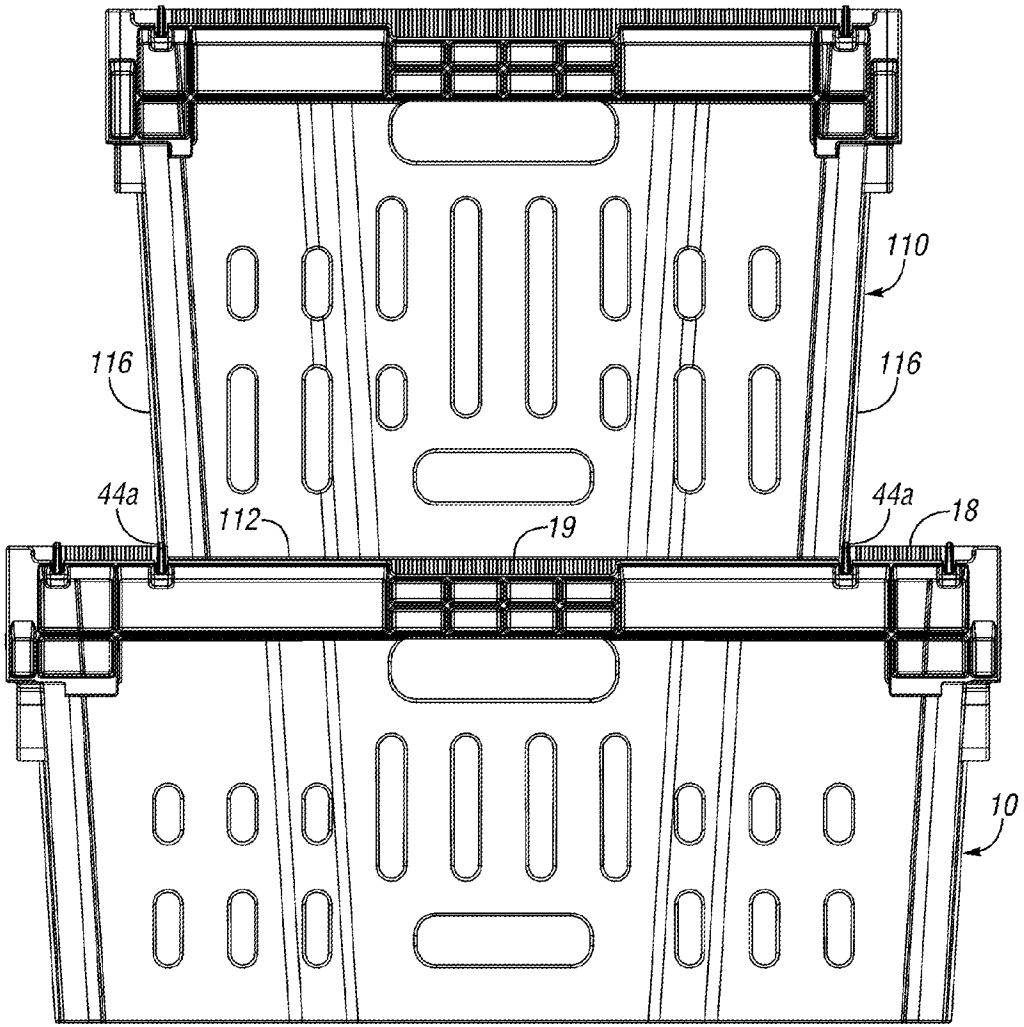
FIG. 27 is a side view of the containers of FIG. 26.
Figure 28:
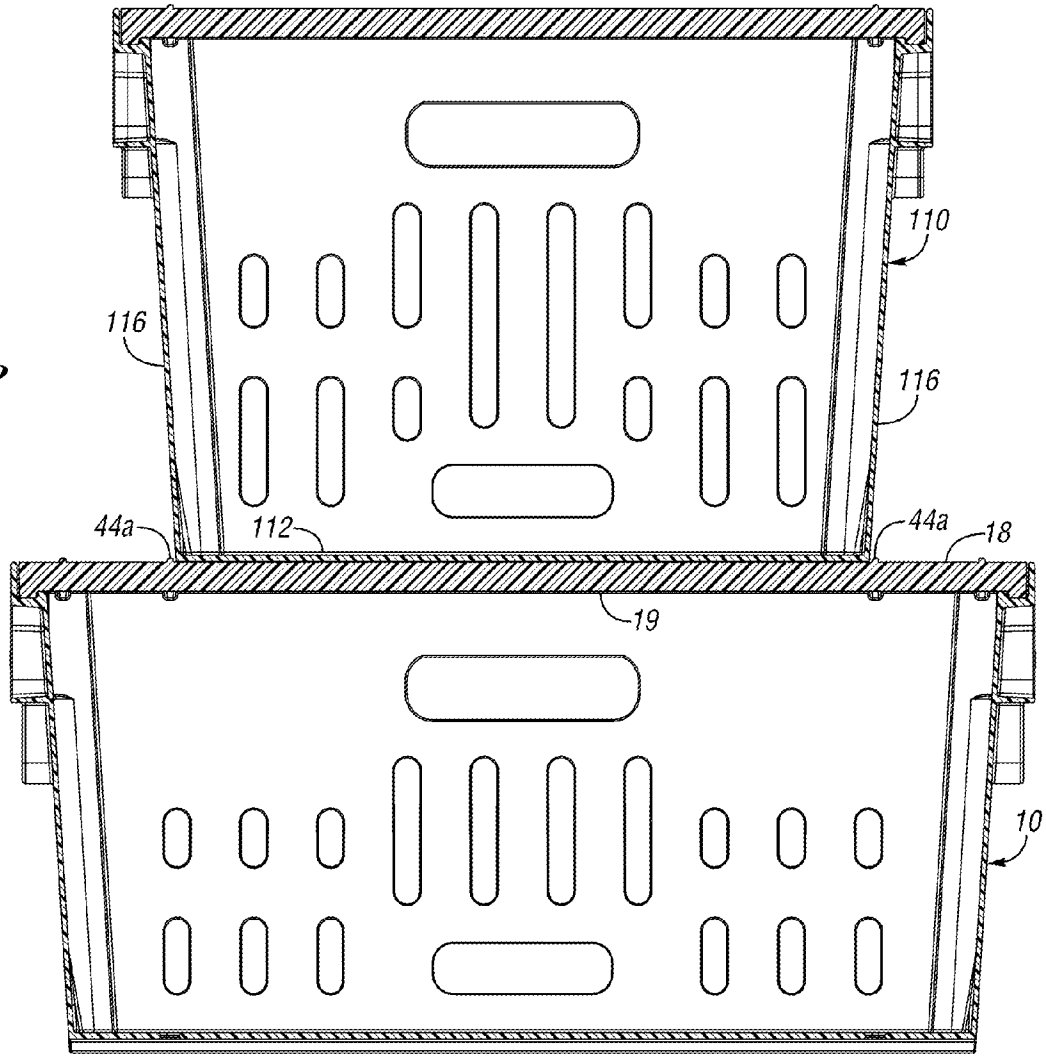
FIG. 28 is a sectional view of the containers of FIG. 27 taken through a bail member of the lower container.

FIGS. 26-28 illustrate the container 110 stacked on the container 10 while the bail members 18 are in the upper stack position. As shown, the notch 117 of the upper container 110 aligns with the bail member 18 in the upper stack position. As shown in FIGS. 27-28, the floor 112 and bottom edges of end walls 116 rest on the bail members 18 between the inner interlocking projections 44*a* on the support portion 19 of the bail members 18. The interlocking of the inner interlocking projections 44*a* with the floor 112 and end walls 116 prevent lateral movement of the upper container 110 when stacked on the bail members 18 of the lower container 10 when the bail members 18 are in certain of the multiple positions.

Figure 29:
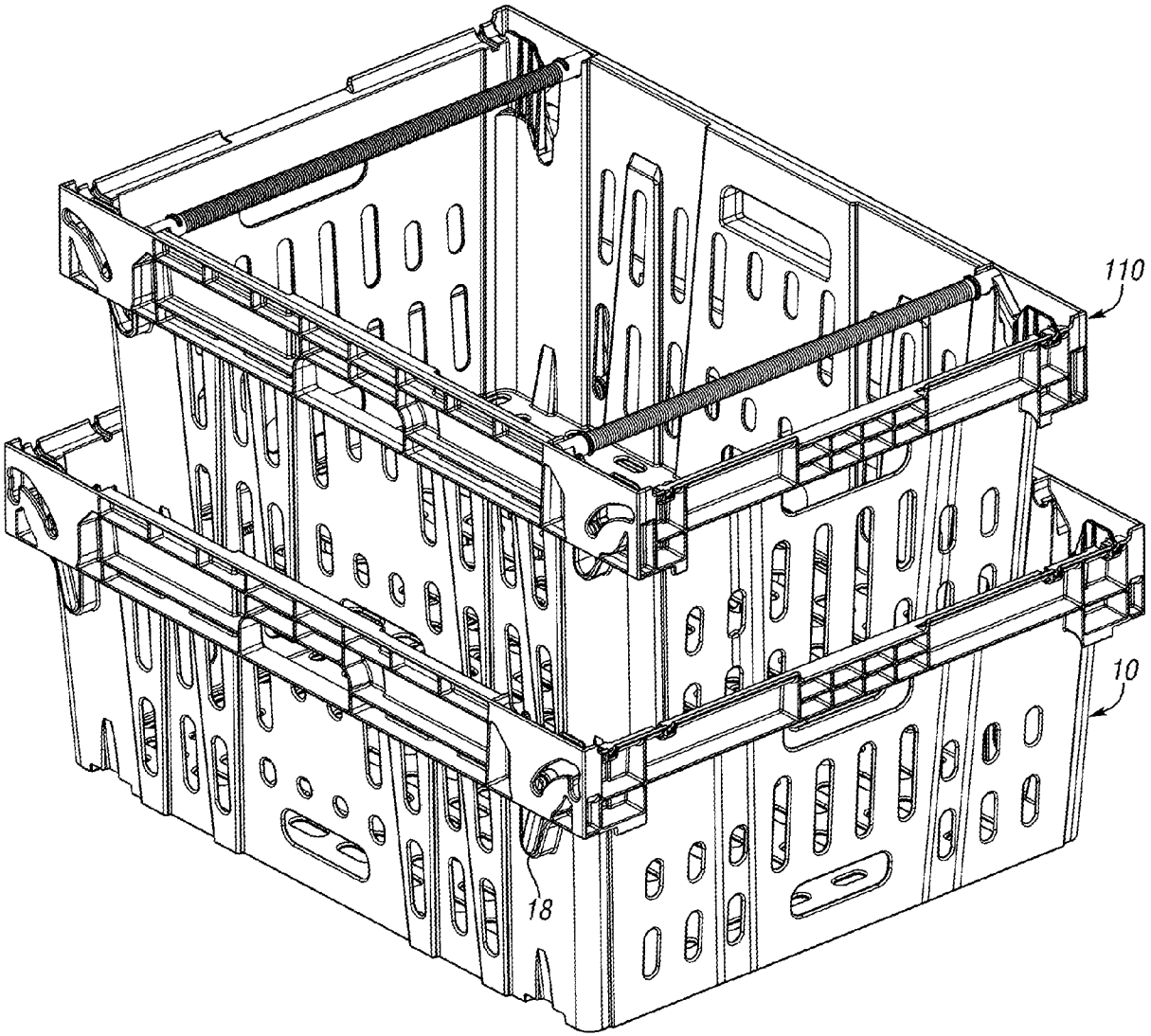
FIG. 29 is a perspective view of the containers of FIG. 23, with the bail members of the lower container in the low stack position.
Figure 30:
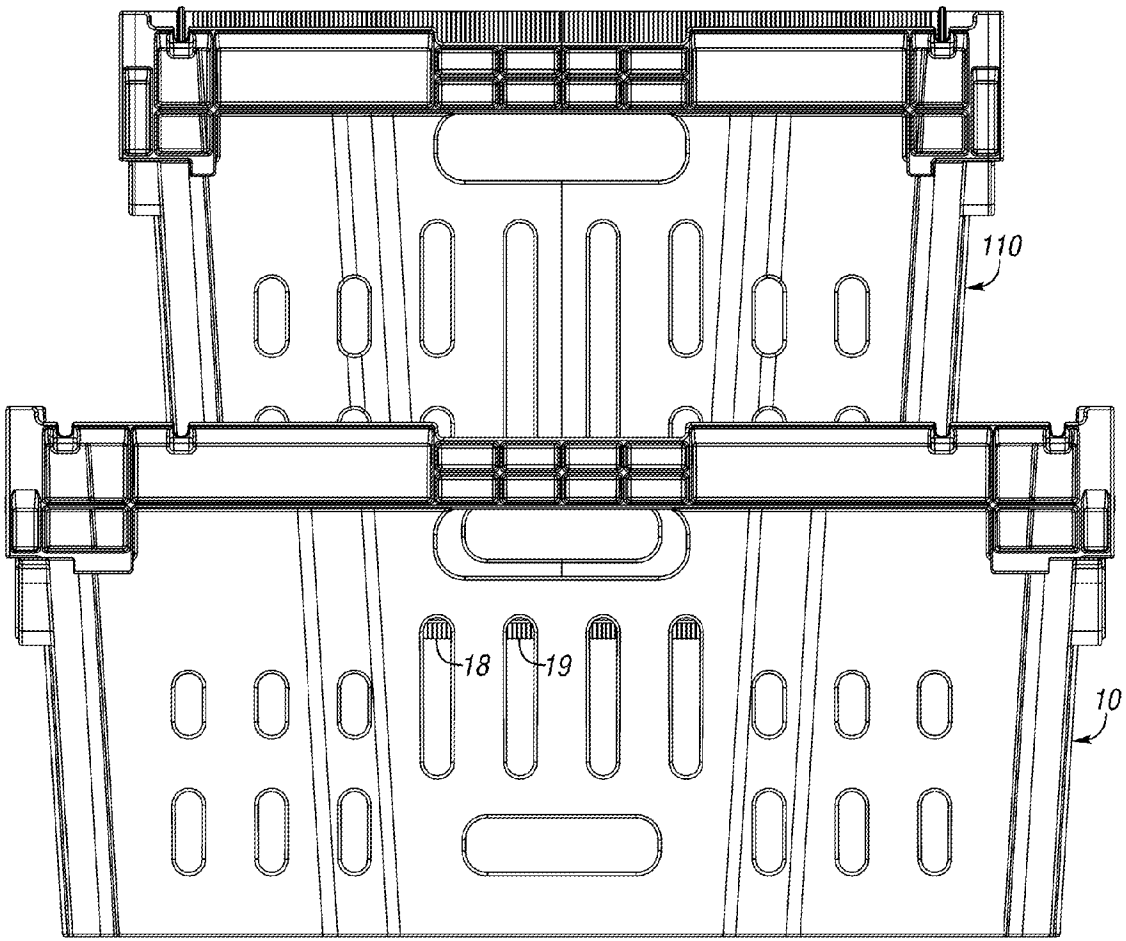
FIG. 30 is a side view of the containers of FIG. 29.
Figure 31:
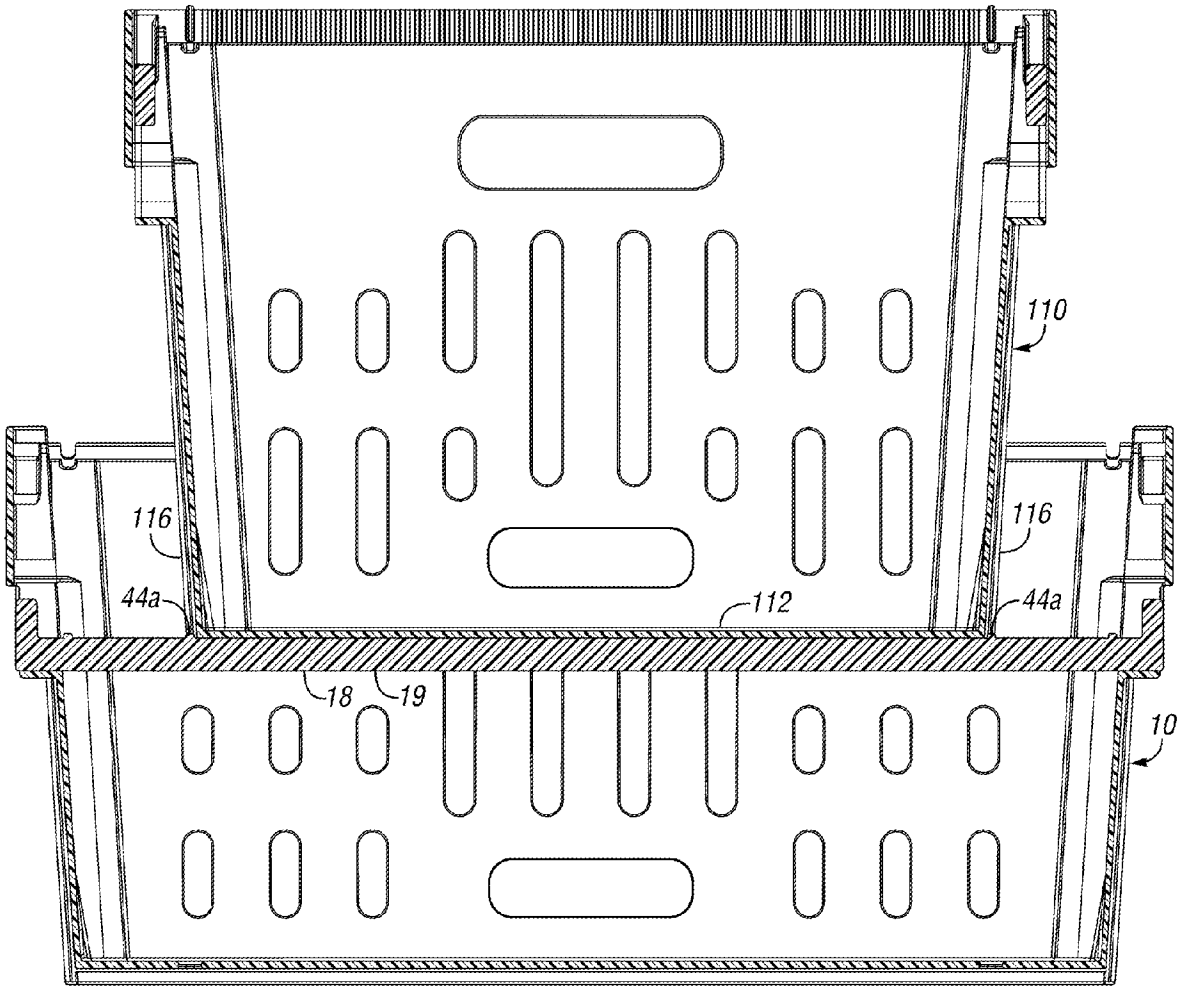
FIG. 31 is a sectional view of the containers of FIG. 30 taken through a bail member of the lower container.

FIGS. 29-31 illustrate the container 110 stacked on the container 10 while the bail members 18 are in the low stack position. As shown, the notch 117 of the upper container 110 aligns with the bail member 18 in the low stack position. As shown in FIG. 31, the floor 112 and bottom edges of end walls 116 rest on the bail members 18 between the inner interlocking projections 44*a* on the support portion 19 of the bail members 18. The interlocking of the inner interlocking projections 44*a* with the floor 112 and end walls 116 prevent lateral movement of the upper container 110 when stacked on the bail members 18 of the lower container 10 when the bail members 18 are in certain of the multiple positions, including the low nest position.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. There are different designs of containers that would benefit from the present invention.

What is claimed is:

1. A container capable of supporting a second container in a plurality of positions relative to the container, the container comprising:

a floor;

an upstanding wall structure including a plurality of walls extending upwardly from the floor; and a bail member having a support portion and an arm extending transversely from the support portion, the support portion including a first pair of axially-spaced radial projections between opposite axial ends of the support portion and a second pair of axially-spaced radial projections vertically aligned with outer edges of the floor, such that the second pair of redial projections would be adjacent a floor of a like container stacked thereon when the support portion is in the stacking position, the first pair of radial projections spaced from one another by a distance less than that of the second pair of radial projections, the bail member selectively movable between a nest position and a stacking position, wherein the support portion is vertically aligned outwardly of an outer periphery of the floor in the nest position, and the support portion is vertically aligned with the floor in the stacking position, wherein the floor includes a bottom surface having at least one recess for receiving the first pair of radial projections of a like container stacked therebelow.

2. The container of claim 1 wherein the first pair of radial projections extend only partially around the support portion.

3. The container of claim 1 wherein the at least one recess includes two recesses and wherein the first pair of radial projections are each aligned with one of the two recesses such that each recess would receive therein the first radial projection of the like container stacked therebelow.

4. A stack of containers wherein the container of claim 3 is a lower container and further including a smaller container stacked on the lower container, the smaller container having a floor and upstanding walls at the periphery of the floor, the floor having an outer dimension approximate the distance between the first pair of radial projections, such that the smaller container is laterally constrained by the first pair of radial projections relative to the lower container.

5. The container of claim 1 wherein the first pair of radial projections extend only partially around the support portion, such that the first pair of radial projections project upwardly when the bail member is in a first position and such that the first pair of radial projections do not project upwardly when the bail member is in a second position, different from the first position.

6. The container of claim 5 wherein the first position is one of the nest position and the stack position and wherein the second position is the other of the nest position and the stack position.

7. A container capable of supporting a second container in a plurality of positions relative to the container, the container comprising:

a floor;

an upstanding wall structure including a plurality of walls extending upwardly from the floor; and a bail member having a support portion and an arm extending transversely from the support portion, wherein the support portion of the bail member includes a plurality of alternating recesses and protrusions along substantially the entire outer surface of the support portion of the bail member, the support portion including at least one radial projection between the opposite axial ends of the support portion, the bail member selectively movable between a nest position and a stacking position, wherein the support portion is vertically aligned outwardly of an outer periphery of the floor in the nest position, and the support portion is vertically aligned with the floor in the stacking position, wherein the at least one radial projection would be adjacent a floor of a like container stacked thereon when the support portion is in the stacking position, wherein the floor includes a bottom surface having at least one recess for receiving the at least one radial projection of a like container stacked therebelow.

8. The container of claim 7 wherein the alternating recesses and protrusions extend circumferentially about the support portion.

9. The container of claim 8 wherein the recesses have an axial width approximately equal to a width of the protrusions.

10. A container capable of supporting a second container in a plurality of positions relative to the container, the container comprising:

a floor;

an upstanding wall structure including a plurality of walls extending upwardly from the floor; and a bail member having a support portion and a pair of arms extending transversely from the support portion, the support portion including a plurality of alternating recesses and protrusions on substantially all of the support portion between the pair of arms, the bail member selectively movable between a nest position and a stacking position, wherein the support portion is vertically aligned outwardly of an outer periphery of the floor in the nest position, and the support portion is vertically aligned with the floor in the stacking position.

11. The container of claim 10 wherein the support portion of the bail member includes a plurality of microribs providing the alternating recesses and protrusions.

12. The container of claim 11 wherein outer surfaces of the plurality of microribs are approximately equal to space between the microribs.

13. The container of claim 10 wherein the alternating recesses and protrusions extend circumferentially about the support portion.

14. The container of claim 10 wherein the alternating recesses and protrusions are on at least an upper surface of the support portion and a lower surface of the support portion.

15. A container capable of supporting a second container in a plurality of positions relative to the container, the container comprising:

a floor;

an upstanding wall structure including a plurality of walls extending upwardly from the floor; and a bail member having a support portion and an arm extending transversely from the support portion, the support portion including a plurality of alternating recesses and protrusions along substantially the entire outer surface of the support portion, the support portion including at least one radial projection between opposite axial ends of the support portion, the at least one radial projection at least several time greater in radial height than the alternating protrusions, the bail member selectively movable between a nest position and a stacking position, wherein the support portion is vertically aligned outwardly of an outer periphery of the floor in the nest position, and the support portion is vertically aligned with the floor in the stacking position.

16. The container of claim 15 wherein the at least one radial projection extends only partially around the support portion.

17. The container of claim 15 wherein the at least one radial projection includes a first pair of axially-spaced radial projections.

18. The container of claim 17 wherein the at least one radial projection further includes a second pair of axially-spaced radial projections, each at least several times greater in height than the alternating projections.

19. A container capable of supporting a second container in a plurality of positions relative to the container, the container comprising:

a floor;

an upstanding wall structure including a plurality of walls extending upwardly from the floor, the wall structure including a notch; and a bail member having a support portion and an arm extending transversely from the support portion, the arm pivotably mounted to one of the plurality of walls at a pivot point, the arm including a lateral projection between the pivot point and the support portion, the bail member selectively movable between a nest position and a stacking position in which the support portion is received in the notch and supported on the wall structure defining the notch, wherein the support portion is vertically aligned outwardly of an outer periphery of the floor in the nest position, and the support portion is vertically aligned with the floor in the stacking position, wherein the lateral projection interlocks with a contoured surface on the upstanding wall structure of the container when the bail member is in the stacking position.

20. The container of claim 19 wherein the lateral projection increases an overall width of the arm.

21. The container of claim 19 wherein the contoured surface of the wall structure is spaced away from the notch.

22. The container of claim 21 wherein the contoured surface of the wall structure is spaced above the notch.

23. A container capable of supporting a second container in a plurality of positions relative to the container, the container comprising:

a floor;

a pair of end walls proximate opposite peripheral edges of the floor; and a bail member having an elongated support portion, the support portion including at least one interlocking member between opposite axial ends of the support portion, the bail member selectively movable between a nest position, a first stacking position and a second stacking position lower than the first stacking position, wherein the at least one interlocking member is vertically aligned with an outer edge of the floor, such that the at least one interlocking member would project upwardly adjacent a floor of a like container stacked thereon when the bail member is in the first stacking position and when the bail member is in the second stacking position, wherein the support portion is vertically aligned outwardly of an outer periphery of the floor when the bail member is in the nest position, and the support portion is vertically aligned with the floor when the bail member is in the first stacking position and the second stacking position.

24. The container of claim 23 wherein the at least interlocking member includes at least one radial projection extends radially outwardly from the support portion.

25. The container of claim 24 wherein the at least one radial projection extends only partially around the support portion.

26. The container of claim 24 wherein the at least one interlocking member includes a first pair of axially-spaced interlocking members.

27. The container of claim 26 wherein the at least one interlocking member further includes a second pair of axially-spaced projections.

28. A container capable of supporting a second container in a plurality of positions relative to the container, the container comprising:

a floor;

an upstanding wall structure including a plurality of walls extending upwardly from the floor; and a bail member having a support portion and an arm extending transversely from the support portion, the arm pivotably mounted to one of the plurality of walls at a pivot point, the arm including a first lateral projection and a second lateral projection opposite the first lateral projection, the first lateral projection and the second lateral projection between the pivot point and the support portion, the bail member selectively movable between a nest position and a stacking position, wherein the support portion is vertically aligned outwardly of an outer periphery of the floor in the nest position, and the support portion is vertically aligned with the floor in the stacking position, wherein the first lateral projection interlocks with a contoured surface on the upstanding wall structure of the container when the bail member is in the stacking position.

29. A container capable of supporting a second container in a plurality of positions relative to the container, the container comprising:

a floor;

an upstanding wall structure including a plurality of walls extending upwardly from the floor; and a bail member having a support portion and an arm extending transversely from the support portion, the support portion including at least one radial projection between opposite axial ends of the support portion, the bail member selectively movable between a nest position and a stacking position, wherein the support portion is vertically aligned outwardly of an outer periphery of the floor in the nest position, and the support portion is vertically aligned with the floor in the stacking position, wherein the at least one radial projection would be adjacent a floor of a like container stacked thereon when the support portion is in the stacking position, wherein the at least one radial projection extends only partially around the support portion, such that the at least one radial projection projects upwardly when the bail member is in a first stacking position and when the bail member is in a second stacking position lower than the first stacking position, and such that the at least one radial projection does not project upwardly when the bail member is in a nest position.

* * * * *